US007458670B2

(12) United States Patent
Kuki et al.

(10) Patent No.: US 7,458,670 B2
(45) Date of Patent: Dec. 2, 2008

(54) CLOTH PRINTING APPARATUS

(75) Inventors: Masakazu Kuki, Ichinomiya (JP); Hiroshi Kitazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 116 days.

(21) Appl. No.: 10/599,464

(22) PCT Filed: Jan. 26, 2005

(86) PCT No.: PCT/JP2005/000998

§ 371 (c)(1),
(2), (4) Date: Sep. 29, 2006

(87) PCT Pub. No.: WO2005/100669

PCT Pub. Date: Oct. 27, 2005

(65) Prior Publication Data

US 2007/0200907 A1 Aug. 30, 2007

(30) Foreign Application Priority Data

Mar. 30, 2004 (JP) ..... 2004-098234

(51) Int. Cl.
*B41J 2/01* (2006.01)
*B41J 3/00* (2006.01)

(52) U.S. Cl. ..... 347/101; 347/4; 347/104

(58) Field of Classification Search ..... 347/101, 347/104, 4

See application file for complete search history.

(56) References Cited

U.S. PATENT DOCUMENTS 5,172,138 A * 12/1992 Okazawa et al. ..... 346/134
6,120,126 A 9/2000 Nakahara
6,979,080 B2 12/2005 Samoto et al.
2002/0109749 A1* 8/2002 Matsumura ..... 347/36
2002/0180821 A1* 12/2002 Cook ..... 347/19
2003/0197772 A1* 10/2003 Iwatsuki et al. ..... 347/104

(Continued)

FOREIGN PATENT DOCUMENTS

EP 0 865 924 A2 9/1998

(Continued)

OTHER PUBLICATIONS

International Search Report, Appl'n No. PCT/JP2005/000998 mailed May 17, 2005.

*Primary Examiner*—Julian D Huffman
*Assistant Examiner*—Jason S Uhlenhake
(74) *Attorney, Agent, or Firm*—Baker Botts L.L.P.

(57) ABSTRACT

An inkjet cloth printing apparatus includes a head moving mechanism moving the print head in a first direction, a cloth holder holding a periphery of a printing area of cloth on which the apparatus prints and including a first holding member and a second holding member fitted with an outer portion of the first holding member, a holder moving mechanism feeding the cloth holder in a second direction below the print head, the holder moving mechanism including a rack, a pinion brought into mesh engagement with the rack, and a drive motor rotating the pinion, and a cloth passage defined below a movement space through which the cloth holder is moved in the second direction by the holder moving mechanism so as to allow movement of part of the cloth located outside the printing area and running out of the cloth holder.

17 Claims, 20 Drawing Sheets

U.S. PATENT DOCUMENTS

2004/0179047 A1* 9/2004 Niimi ..... 347/4
2006/0012658 A1 1/2006 Samaoto et al.

FOREIGN PATENT DOCUMENTS

JP H8-311783 A 11/1996
JP 2003-63713 A 3/2003
JP 2003063713 A 3/2003
JP 2003-312069 A 11/2003
JP 2004-074807 A 3/2004
WO 2005/100669 A1 10/2005

* cited by examiner

CLOTH PRINTING APPARATUS

TECHNICAL FIELD

The present invention relates to an inkjet cloth printing apparatus provided with a print head capable of printing on cloth.

BACKGROUND ART

Various types of inkjet printing apparatus have conventionally been proposed and put into practice. These inkjet printing apparatus are constructed so as to print in colors on plain paper of various sizes such as A4 and B5 or recording paper such as overhead projector (OHP) sheet by an inkjet print head. These printing apparatus are constructed so as to feed recording paper sheet by sheet in a paper feeding direction and to inject ink from inkjet nozzles provided on the print head while reciprocally moving a print head in a printing direction perpendicular to the paper feeding direction.

For example, JP-A-2003-63713 discloses an inkjet recording apparatus which is constructed so as to feed, sheet by sheet, a plurality of sheets or recording paper set in a paper feed tray to a printing section by paper feed rollers and conveying rollers and to eject the recording paper from the printing section by paper ejecting rollers. Small-sized desktop inkjet printing apparatus of the aforesaid type have come into wide use, so that high-speed color printing can be realized on various types of recording materials with different sizes and paper quality.

DISCLOSURE OF THE INVENTION

Problem to be Overcome by the Invention

Meanwhile, there has recently been an increasing desire to print intended patterns, photograph or the like on cloth such as T-shirts, blouse, handkerchiefs, wrapping cloth or the like using an inkjet printing apparatus as described above. However, since the cloth such as T-shirts, wrapping cloth or the like is more pliable than recording paper, it is difficult for the foregoing printing apparatus for use with recording paper to feed cloth or to print on the cloth. Consequently, for example, it is proposed that a cloth holding frame as used with embroidery machines be employed so that workpiece clothould be held in a state where an area thereof to be printed is stretched taut and so that printing is carried out while the cloth held on the cloth holding frame is fed onto a conveying passage.

In the above-described proposed construction, however, a part of the cloth outside the printing area runs out of the cloth holding frame, hanging downward. As a result, the hanging part of the workpiece cloth would be caught by conveying or ejecting rollers located below the conveying passage, whereupon the cloth would obstruct the feeding of the cloth, be soiled or damaged.

An object of the present invention is to provide a cloth printing apparatus which can print on cloth and desirably feed the cloth without the cloth being soiled or damaged.

MEANS FOR OVERCOMING THE PROBLEM

The present invention provides an inkjet cloth printing apparatus provided with a print head capable of printing on cloth, comprising a head moving mechanism moving the print head in a first direction, a cloth holder holding a periphery of a printing area of the cloth on which the apparatus prints, the cloth holder comprising a first holding member and a second holding member fitted with an outer portion of the first holding member, a holder moving mechanism feeding the cloth holder in a second direction below the print head, the second direction being perpendicular to the first direction, wherein the holder moving mechanism comprises a rack which is formed on the second holding member so as to extend in the second direction, a pinion which is brought into mesh engagement with the rack, and a drive motor which rotates the pinion, wherein the second holding member has a slide groove formed therein for position restriction, and the slide groove extends in the second direction, an engaging member provided on an apparatus body side for engaging the slide groove, and a cloth passage defined below a movement space through which the cloth holder is moved in the second direction by the holder moving mechanism so as to allow movement of part of the cloth located outside the printing area and running out of the cloth holder.

EFFECT OF THE INVENTION

In the cloth printing apparatus of the invention, the cloth passage is ensured below the movement space through which the cloth holder is moved in the second direction by the holder moving mechanism. Accordingly, even when the cloth hangs down from the cloth holder, a hanging part of the cloth can be moved without obstruction. Consequently, the cloth can be prevented from being soiled or damaged and can smoothly be fed, whereupon the printing can be carried out desirably.

EXPLANATION OF REFERENCE SYMBOLS

1 . . . a cloth printing apparatus, 1*a* . . . a body frame, 1*m* . . . an engagement part (engaging member), 3 . . . a cloth passage, 5, 5A, 5B . . . a cloth holder, 6 . . . an inner holding member (first holding member), 6A, 6B . . . a first holding member, 7 . . . an outer holding member (second holding member), 7A, 7B . . . a second holding member 7*a* . . . a rack, 7*b* . . . a slide groove, 11 . . . a print head, 20 . . . a head moving mechanism, 30 . . . a holder moving mechanism, 32 . . . a pinion, 34 . . . a drive motor, 40 . . . a purging unit, 41 . . . a cap, 48 . . . a passage height adjusting leg (passage height adjusting unit), 50 . . . a control unit, 51 . . . a carriage origin position detecting sensor (first origin position setting unit), 52 . . . a carriage origin detection member (first origin detection member), 53 . . . a holder origin position detecting sensor (second origin position setting unit), 54 a cloth holder origin detection member (second origin detection member), 65, 70 . . . a support frame, 71 . . . a magnet position switching mechanism (magnet position switching unit), 78 . . . a cloth accommodating member, and W . . . workpiece cloth.

BEST MODE FOR CARRYING OUT THE INVENTION

Figure 1:
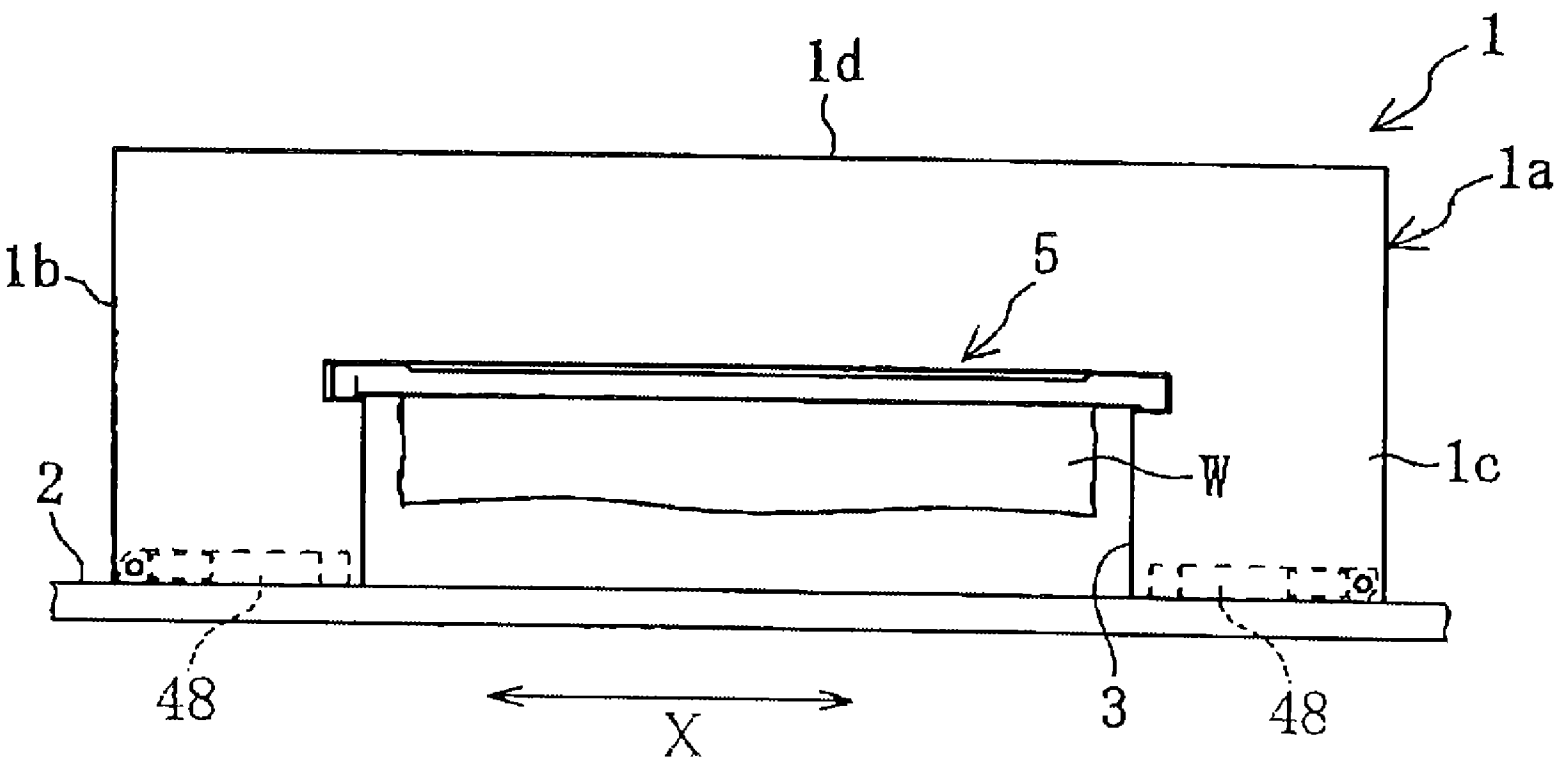
FIG. 1 is a front view of a cloth printing apparatus of a first embodiment in accordance with the present invention.
Figure 2:
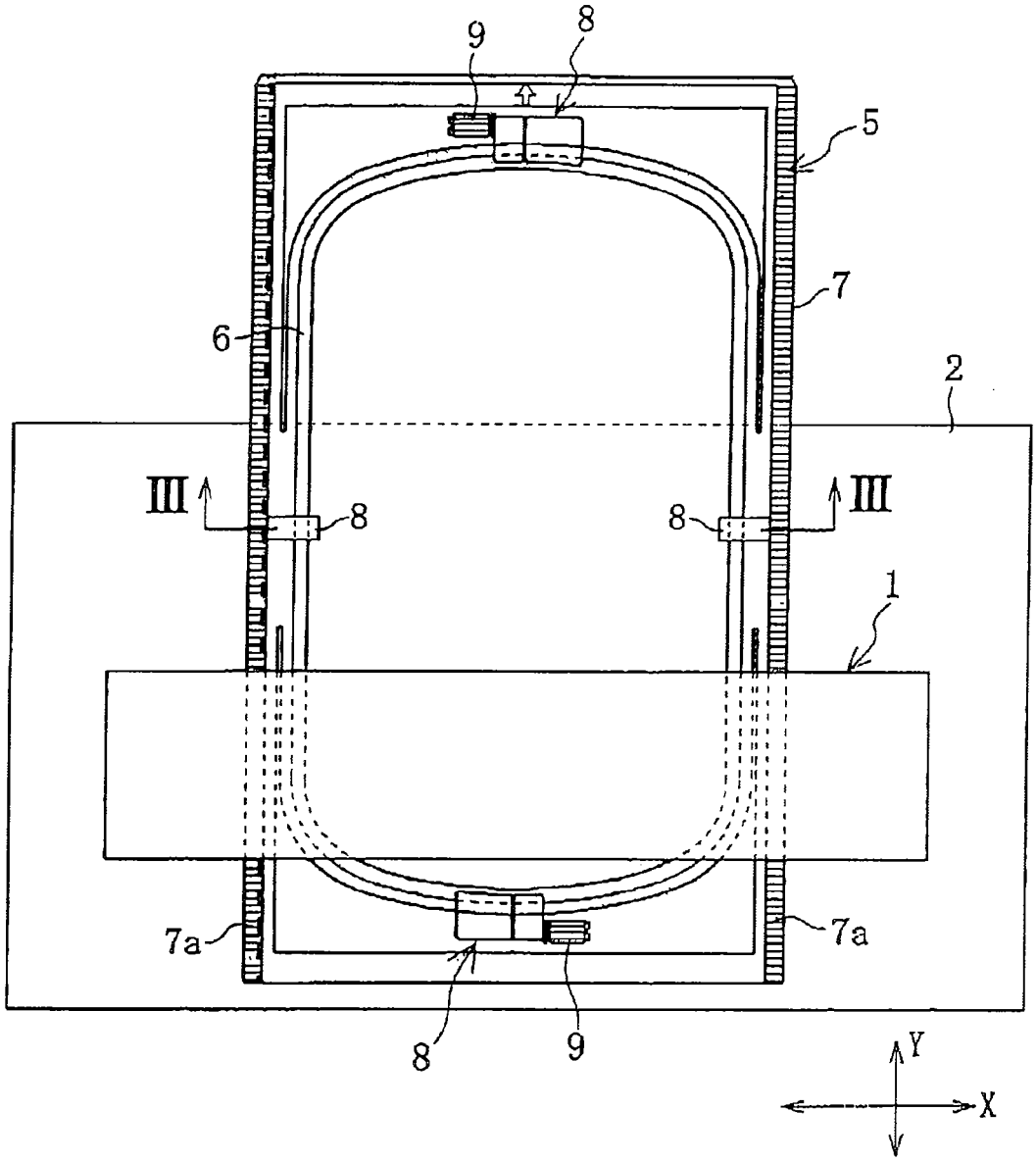
FIG. 2 is a plan view of the cloth printing apparatus.

The invention will be described in more detail with reference to the accompanying drawing. FIGS. 1 to 11 illustrate a first embodiment of the present invention. Referring to FIGS. 1 and 2, an appearance of the cloth printing apparatus 1 of the embodiment for printing on workpiece cloth (see FIG. 3). A body frame 1*a* constituting the body of the cloth printing apparatus 1 is placed on and fixed to a work table 2. The body frame 1*a* has a left leg frame 1*b*, a right leg frame 1*c* and an installation frame 1*d* horizontally extending between upper parts of the leg frames 1*b* and 1*c*, all of which are formed integrally into an arcuate shape (downwardly directed C shape). In the embodiment, as shown in FIG. 2 and the like, a horizontal direction of the body frame 1*a* which is a first direction is defined as an X direction, and a crosswise direction which is a second direction and is perpendicular to the first direction.

Figure 4:
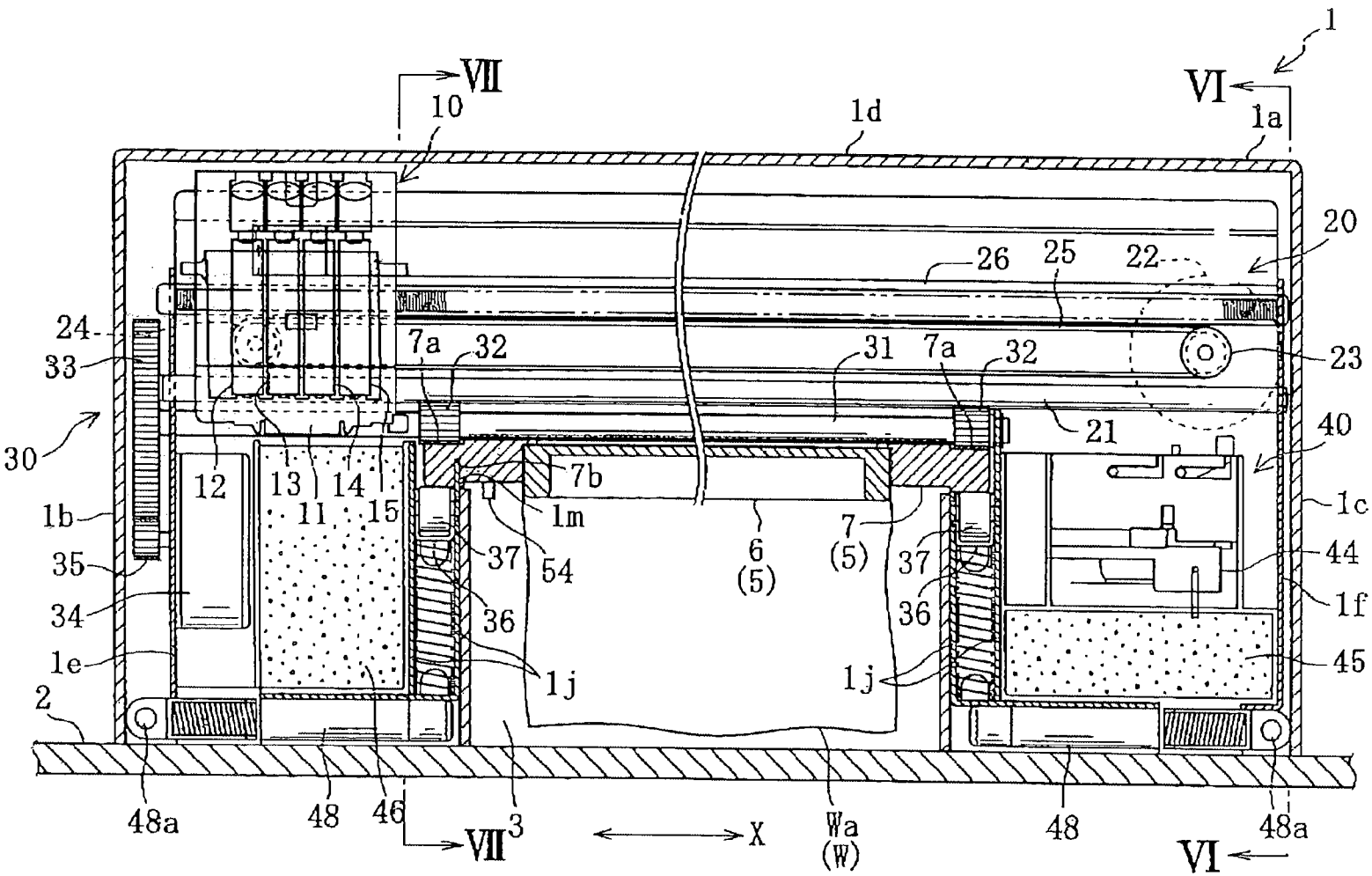
FIG. 4 is a longitudinally sectional front view of the cloth printing apparatus.

In the left leg frame 1*b* are provided, as shown in FIG. 4 and the like, an ink absorbing member 46 absorbing ink injected by the flushing of the print head 11 printing characters and figures on workpiece cloth, a holder driving motor 34 serving as a drive source for moving the cloth holder 5 holding the workpiece cloth W in Y direction (crosswise direction), and the like. In the right leg frame 1*c* are provided a purging unit 40 purging the print head 11 and an ink absorbing member 45 absorbing ink discharged by the purge, and the like.

In the installation frame 1*d* are provided a carriage having the print head 11, a head moving mechanism 20 moving the carriage 10 in X direction, a holder moving mechanism 30 moving the cloth holder 5 in Y direction, and the like. A cloth passage is adapted to be defined between the right and left leg frames 1*b* and 1*c* below the installation frame 1*d*. In this case, an underside of the installation frame 1*d* includes a part which faces the cloth passage 3 and is open.

Figure 3:
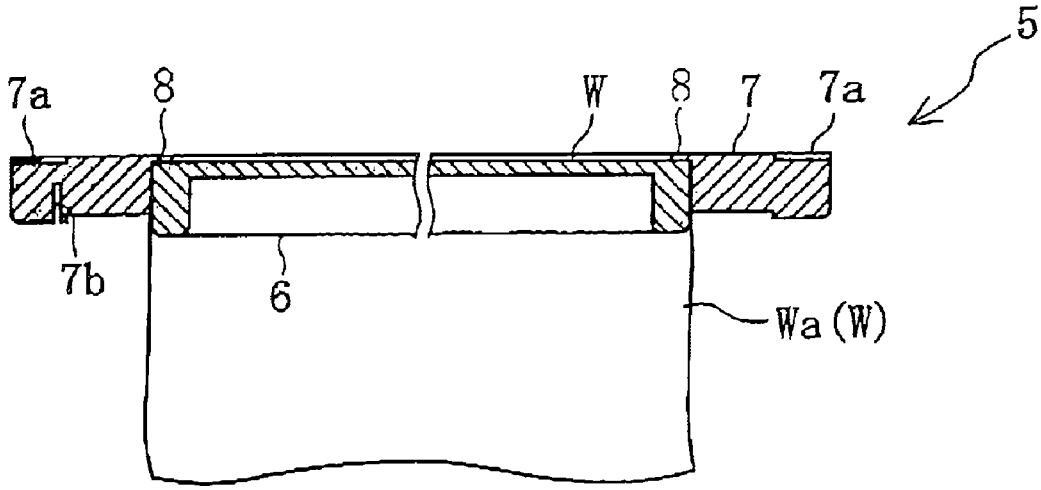
FIG. 3 is a longitudinally sectional front view of a cloth holder taken along line 3-3 in FIG. 2.

In this cloth printing apparatus 1, the workpiece cloth W on which the apparatus is to print is held by the cloth holder 5. The cloth holder 5 is constructed as follows. As shown in FIGS. 2 and 3, the cloth holder 5 includes an inner holding member 6 serving as a first holding member and an outer holding member 7 serving as a second holding member and is formed into a crosswise slightly longer rectangular shape as a whole. The inner holding member 6 is formed into the shape of a plate with curved front and rear sides and has a wall which is formed on an underside thereof so as to protrude downward. The workpiece cloth W is set so as to be placed on an upper surface of the inner holding member 6.

On the other hand, the second holding member 7A includes a rectangular support frame 67 and a rectangular frame member 66 formed integrally on an upper surface of the support frame 67. The support frame 67 is made of a non-magnetic material such as a synthetic resin, for example, and has an opening corresponding to (or slightly larger than) the shape of an outer periphery of the first holding member 6A. Furthermore, racks 7*a* extend the whole crosswise dimension of the support frame 67 along right and left sides of the upper surface of the support frame 67. The pinions 32 of the holder moving mechanism 30 are to come into mesh engagement with the racks 7*a*. Furthermore, a slide groove 67*b* is formed in the underside of the left end of the support frame 67 so as to extend the entire length of the support frame 6 in the movement direction of the cloth holder 5A (Y direction). The slide groove 67*b* engages the engagement portion 1*m*.

When the workpiece cloth W is to be held on the cloth holder 5, the worker firstly places a printing area of the workpiece cloth on the upper surface of the inner holding member 6, fitting the inner frame of the outer holding member 7 with the outer periphery of the inner holding member. In this case, the outer holding member 7 is pressed downward until the four stopper members 8 abut against the upper surface of the inner holding member 6 (workpiece cloth). The fixing screws 9 are tightened up so that the inner and outer holding members 6 and 7 are coupled to each other with the workpiece cloth being held therebetween as shown in FIG. 3, whereupon the printing area of the workpiece cloth is held in a stretched state on the upper surface of the inner holding member 6. At this time, a part Wa of the workpiece cloth held by the cloth holder 5 runs out of the cloth holder, hanging downward.

Furthermore, racks 7*a* having predetermined widths are provided on upper surfaces of right and left sides of the outer holding member 7 (outer frame) so as to extend by an entire crosswise dimension of the outer holding member, respectively. Each rack 7*a* is adapted to be brought into mesh engagement with a pinion 32 (see FIG. 4 etc.) of the holder moving mechanism 30. Furthermore, as shown in FIGS. 3 and 4, a position regulation slide groove 7*b* is formed over the entire underside of the left end of the outer holding member 7 (outer frame). The slide groove 7*b* extends in the moving direction of the cloth holder 5 (Y direction). When the cloth holder 5 is set on the holder moving mechanism 30 as will be described later, an engaging part 1*m* (see FIG. 4) serving as an engaging member provided on a body frame 1*a* (left leg frame 1*b*) engages the slide groove 7*b* from below. As a result, the cloth holder 5 is adapted to be guided in the Y (crosswise) direction without displacement in the X (horizontal) direction in the movement.

The print head 11 and the head moving mechanism 20 will next be described with reference to FIGS. 4 to 7. The print head 11 carries out color printing on the workpiece cloth. The head moving mechanism 20 moves the print head 11 in the X direction. The print head 11 is mounted on a lower end of the carriage 10 so as to be directed downward and is reciprocated in the X (horizontal) direction in the installation frame 1*d*.

The print head 11 has the same construction as generally used inkjet color print heads. Four rows of nozzles are arranged in the X direction on a head surface of the print head 11 although not shown in detail in the figures. The four rows of nozzles are capable or injecting four colors of ink, that is, magenta (M), yellow (Y), cyan (C) and black (B). Each row includes a predetermined number (75, for example) of inkjet nozzles zigzag arranged in the Y direction.

Each inkjet nozzle is provided with a piezoelectric ceramic actuator which receives a print drive signal from a control unit 50 (shown in only FIG. 9) Lo deform so that a slight amount of ink is injected downward from each inkjet nozzle. Four ink cartridges 12 to 15 (see FIG. 4) storing ink of the colors, that is, magenta (M), yellow (Y), cyan (C) and black (B) are provided on an upper surface of the print head 11. The ink stored in each one of the ink cartridges 12 to 15 is supplied to the corresponding inkjet nozzles. In this case, the ink cartridges 12 to 15 whose ink has been used up are individually replaced for new one. Various types of print heads other than piezoelectric ceramic actuator type may be employed as the print head 11.

Figure 6:
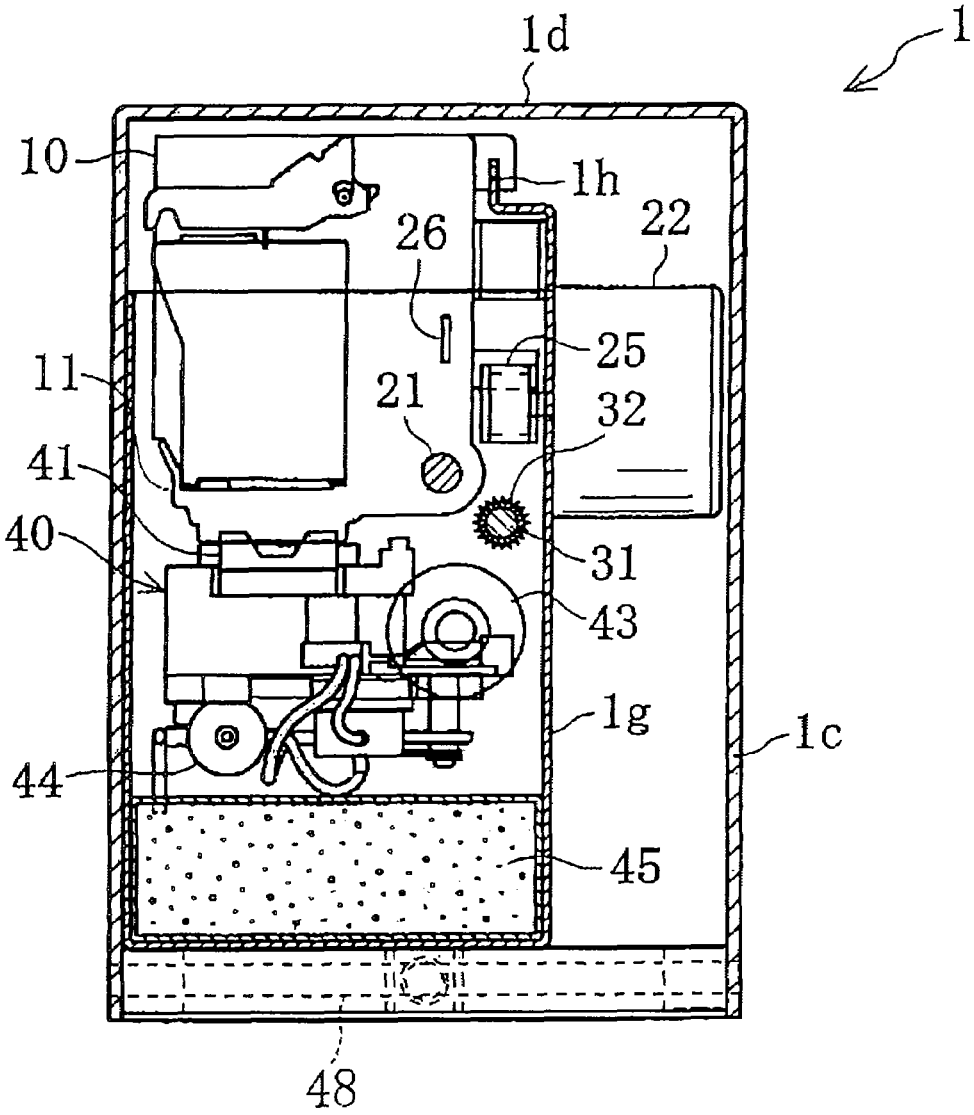
FIG. 6 is a longitudinally sectional right side view of a right leg frame taken along line 6-6 in FIG. 4.
Figure 7:
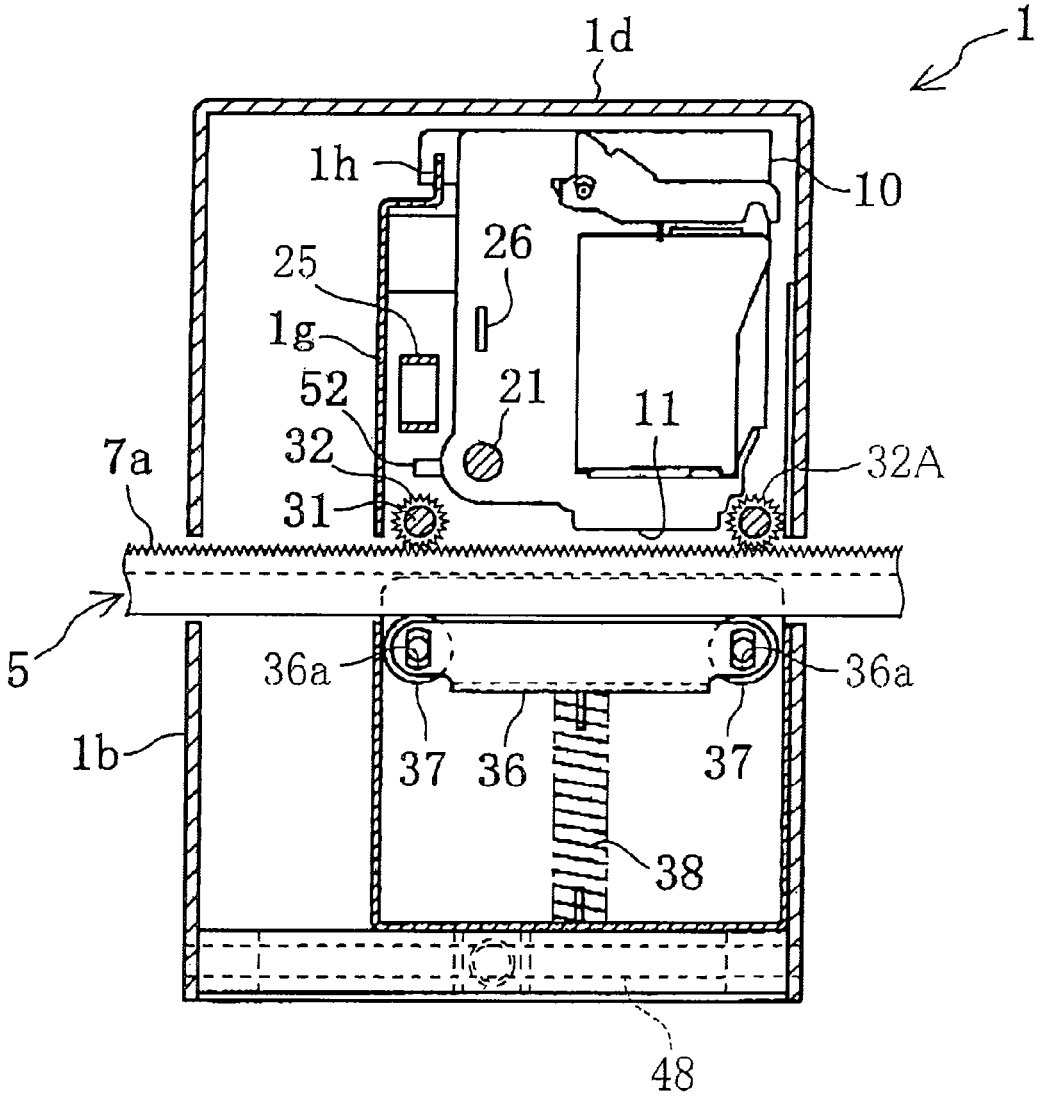
FIG. 7 is a longitudinally sectional left side view of a left leg frame taken along line 7-7 in FIG. 4.

The head moving mechanism 20 will be constructed as follows. As shown in FIG. 4, a left inner frame 1*e* is provided inside the left leg frame 1*b*, whereas a right inner frame 1*f* is provided inside the right leg frame 1*c*. A support shaft 21 is provided on an inner lower part of the installation frame 1*d* so as to extend in the horizontal direction. The support shaft 21 has both ends fixed to the respective inner frames 1*e* and 1*f*. The carriage 10 is slidably inserted into the support shaft 21 so as to be movable along the support shaft in the X direction as shown in FIGS. 6 and 7. Furthermore, a rear frame 1*g* provided in the body frame 1*a* has an upper end on which a guide rail 1*h* bent into a crank shape is provided as shown in FIGS. 6 and 7. An upper end of the carriage 10 is slidably engaged with the guide rail 1*h* so that the carriage is guided.

Figure 5:
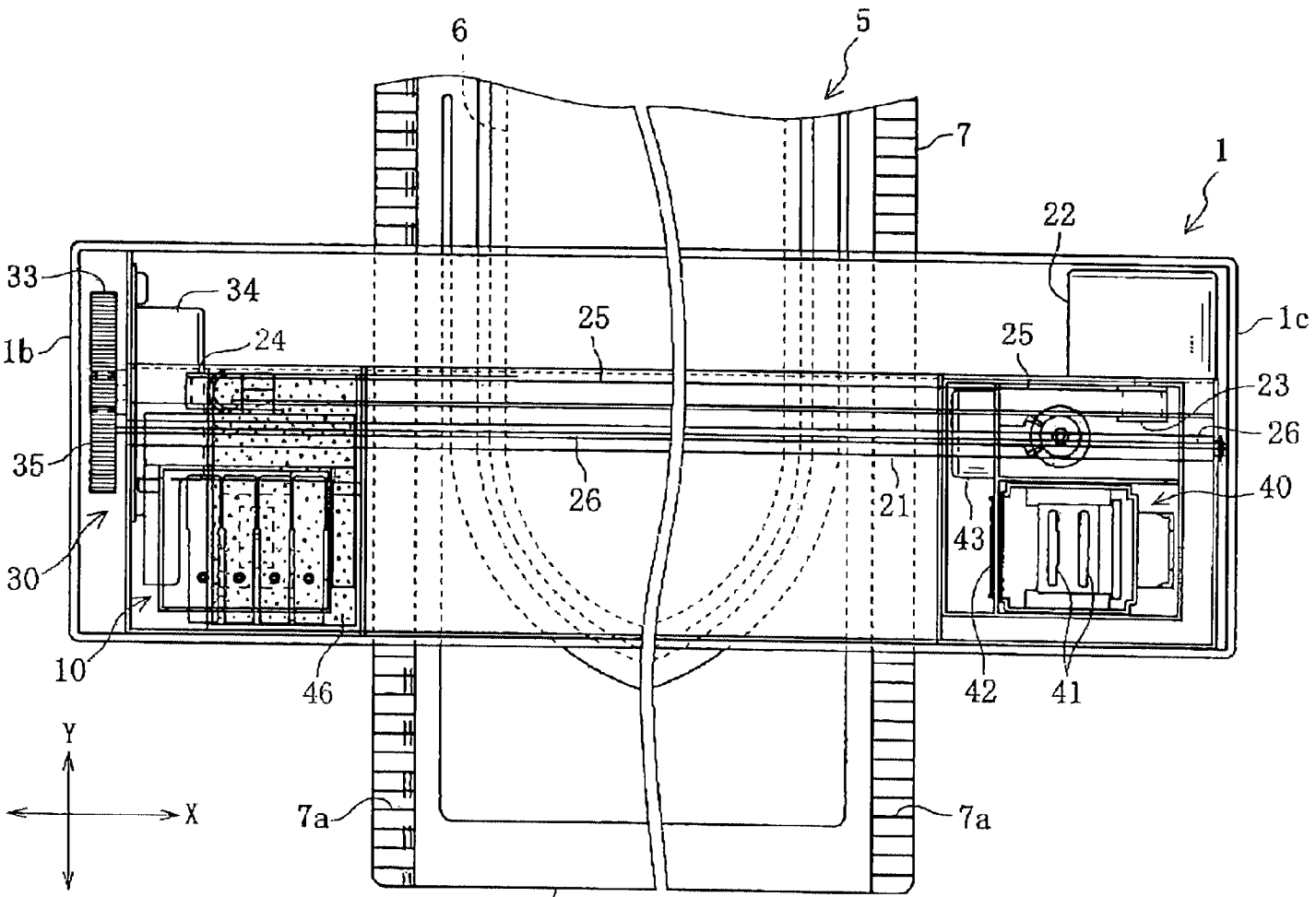
FIG. 5 is a cross-sectional plan view of the cloth printing apparatus.

Referring to FIGS. 4 to 6, a carriage driving motor 22 is mounted on a right end of the rear of the rear frame 1*g* so as to be directed frontward. The carriage driving motor 22 has a rotational shaft on which a driving pulley 23 is mounted as shown in FIGS. 4 and 5. The rear frame 1*g* has a left end on which a driven pulley 24 is rotatably mounted. An endless timing belt 25 extends between the driving pulley 23 and the driven pulley 24. The carriage 10 is coupled to one part of the timing belt 25. As a result, the carriage 10 is moved in the X direction via the pulleys 23 and 24 and the timing belt 25 by a carriage driving motor 22.

Furthermore, an encoder plate 26 is provided in the installation frame 1*d* so as to extend through a rear end of the carriage 10 as shown in FIGS. 4, 6 and 7. The encoder plate 26 has both ends fixed to she inner frames 1*e* and 1*f* and composes a linear encoder. The encoder plate 26 comprises an elongate transparent plate on which longitudinal black thin lines are printed over the whole length at predetermined intervals. The encoder plate 26 is disposed so as to be long crosswise. A photointerrupter 27 (shown in only FIG. 9) is provided in the carriage 10 and includes a light emitting element and a light detecting element both of which are opposed to each other so as to sandwich the encoder plate 26 therebetween. As a result, an encoder signal corresponding to the movement of the carriage 10 in the X direction is delivered from the photo interrupter 27 (the light detecting element) thereby to be supplied into the control unit 50, whereby the movement of the carriage 10 is controllable.

The holder moving mechanism 30 moving (cloth feed) the cloth holder 5 in the Y direction will now be described with reference to FIGS. 1 to 4. A horizontally extending drive shaft 31 is rotatably provided in the body frame 1*a* so as to be located right in the rear of a lower end of the carriage 10 (in tile read of a lower part of the support shaft 21). The drive shaft 31 has a left end pivotally mounted on the left inner frame 1*e* and a right end pivotally mounted on the side wall 1*j* provided or the inner (left) part of the right leg frame 1*c*. The pinions 32 are mounted on positions corresponding to left and right ends of the cloth passage 3 respectively. The pinions 32 are capable of mesh engagement with the racks 7*a* of the cloth holder 5 respectively. Furthermore, as shown in only FIG. 7, rotatable pinions 32A (only one of pinions being shown) are provided at locations corresponding to the pinions 32 at the front end side of the body frame 1*a*, so as to be brought into mesh engagement with the racks 7*a* of the cloth holder 5 respectively.

A driven gear 33 with a large diameter is mounted on a left end of the drive shaft 31 as shown in FIGS. 4 and 5. A holder driving motor 34 is mounted on the left inner frame 1*e* in the left leg frame 1*b* so as to be directed leftward. The holder driving motor 34 has a rotational shaft to which a driving gear 35 with a small diameter. The driving gear 35 is in mesh engagement with the driven gear 33, whereupon the driving gear 31 and accordingly pinion 32 are driven by the drive of the holder driving motor 34.

On the other hand, a pair of front and rear support rollers 37 are provided on the right end of the left leg frame 1*b* and the left end of the right leg frame 1*c* so as to correspond to the pinions 32 and 32A respectively as shown in FIGS. 4 and 7. The support rollers 37 support the undersides of left and right sides of the cloth holder 5 (the outer holding member 7) or hold between the pinions 32 and 32A. The support rollers 37 are rotatably supported on the front and rear portions of roller support members 36 each of which has a U-shaped front and a predetermined crosswise dimension. In this case, as shown in FIG. 7, the support rollers 37 have respective shafts supported in vertically long support holes 36*a* formed in the corresponding roller support member 36, thereby being slightly vertically movable relative to the respective roller support members 36.

The roller support members 36 are elastically supported by compression coil springs 38 on the sidle walls 1*j* (see FIG. 4) provided on the inner (right) portion of the left leg frame 1*b* and the inner (left) portion of the right leg frame 1*c* respectively. As a result, the support rollers 37 are urged upward by spring forces of the compression coil springs 38 respectively, whereupon a sandwiching force can be obtained between the cloth holder 5 and the pinions 32 and 32A. Furthermore, as shown in FIG. 4, an engagement portion 1*m* engaging the slide groove 7*b* of the cloth holder 5 from below is provided integrally on an upper end of the side wall 1*j* in contact with the right side of the left roller support member 36.

The right and left sides of the cloth holder 5 at the distal end side are inserted by the thus constructed holder moving mechanism 30 between the pinion 32A and the support roller 37 from the front, whereupon the pinions 32 and 32A are supported in mesh engagement with the rack 7*a* in a horizontal state. In this state, the cloth holder 5 is moved in the Y direction by rotation of the pinion 32 which is caused by drive of the holder driving motor 34. At this time, the spring force of the compression coil spring 38 causes the rack 7*a* of the cloth holder 5 and the pinion 32 to come into mesh engagement to each other with a strong force. As a result, the cloth holder 5 is accurately moved in the Y direction without slippage or the like. The engagement portion 1*m* engages the slide groove 7*b* formed in the outer holding member 7 of the cloth holder 5, whereby the cloth holder 5 is guided in the Y direction.

As the result of the foregoing construction, the cloth passage 3 is defined below the movement space along which the cloth holder 5 is moved as shown in FIGS. 1 and 4. The cloth passage 3 allows movement of a part Wa of the workpiece cloth located outside the printing area and running out of the cloth holder 5.

Next, the purging unit 40 provided ill the right leg frame 1*c* will be described. Tho purging unit 40 is formed into the shape of a box with an upper opening and includes a head cap 41 and a wiper 42 provided on an upper end thereof as shown in FIGS. 4 to 6, 10 and 11. Both head cap 41 and wiper 42 are made of rubber. The purging unit 40 includes a purging unit vertically moving motor 43 for vertically moving tho purging unit 40, a suction pump 44 connected to the head cap 41, etc. all provided therein. Furthermore, an ink absorbing member 45 made of a material absorbing ink discharged by the purge, for example, felt is provided below the purging unit 40. The head cap 41 is configured into the shape of a cap which is capable of adhering closely to the head surface of the print head 11 from below. When the print head 11 is moved to the purge position (see FIGS. 10 and 11) over the purging unit 40, the purging unit is moved upward by a purging unit vertically moving motor 43 so that the head cap 41 adheres closely to the head surface of the print head 11 from below thereby to close the head surface. Thus, the head surface is closed by the head cap 41 while the printing is not carried out, whereupon a number of inkjet nozzles can be prevented from drying. Furthermore, the purge of the print head 11 is carried out in this state as needed. In this purging operation, the suction pump 44 is driven while the head surface of the print head 11 is closed as the result of vertical movement of the head cap 41. Consequently, the pressure becomes negative inside the head cap 41 so that air bubble or dust is absorbed together with a small amount of ink from the inkjet nozzle of the print head 11 thereby to be removed. Furthermore, thus absorbed ink or the like is absorbed into the ink absorbing member 45.

The wiper 42 comprises a rubber blade and has an upper end which is adapted to be located slightly higher than the head surface of the print head 11. After the purging unit 40 has been moved to the purge position to purge the print bead 11, the head surface of the print head 11 is wiped by the upper end of the wirer 42 when the carriage 10 is moved leftward. Thus, a purging mechanism is comprised of the purging unit 40 having the head cap 41, the suction pump 44 and the like. A capping mechanism is comprised of the purging unit 40 having the head cap 41, the purging unit vertically moving motor 43 and the like.

Furthermore, the ink absorbing member 46 which is made of, for example, felt and provided for absorbing ink in flushing the print head 11. In this case, when ink is not injected for more than a predetermined period of time even during the printing by the print head 11, the print head 11 (carriage 10) is moved to a flushing position (see FIGS. 4 and 5) above the ink absorbing member 46 so that flushing (injecting ink in idle) is carried out. Discharged ink is absorbed by the ink absorbing member 46, whereupon the inkjet nozzles are cleaned.

Figure 8:
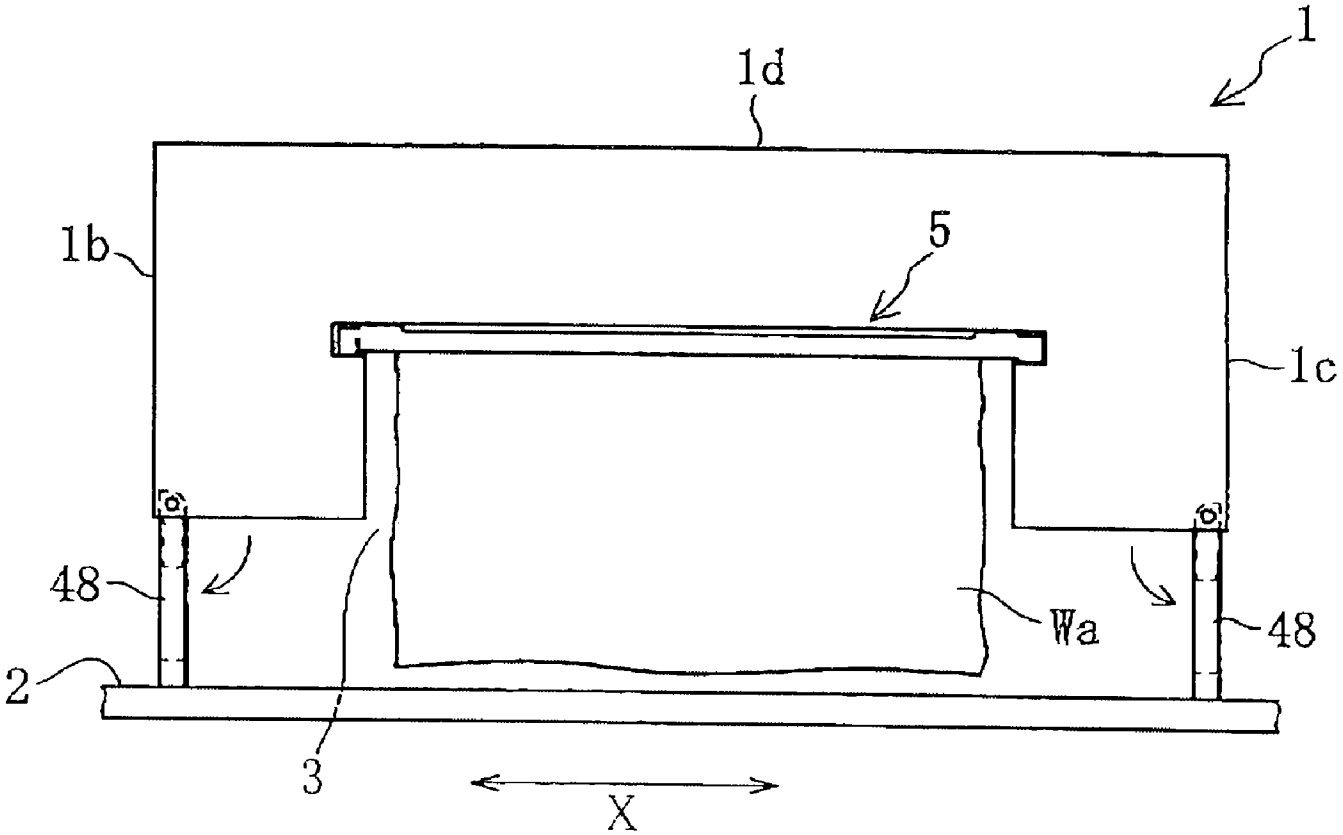
FIG. 8 is a view similar to FIG. 1, showing a passage height adjusting leg in the standing state.

Furthermore, in the embodiment, the right and left leg frames 1*b* and 1*c* have lower ends provided with passage height adjusting legs 48 constituting passage height adjusting units respectively as shown in FIGS. 1, 4, 8, etc. The height adjusting legs 48 are formed into, for example, a C-shape and have both ends which are pivotally supported by pivot pins 48*a* at the front and rear sides of the left and right leg frame 1*b* and 1*c* respectively. As a result, the passage height adjusting legs 48 are switchable between an accommodation position where the legs 48 are accommodated in the lower ends of the leg frames 1*b* and 1*c* as shown in FIG. 4 and an operation position where the legs 48 support the body frame 1*a* so as to lift the work table 2 upward as shown in FIG. 8. In this case, the height and width of the cloth passage 3 is changed depending upon the locations of the passage height adjusting legs 48.

Figure 9:
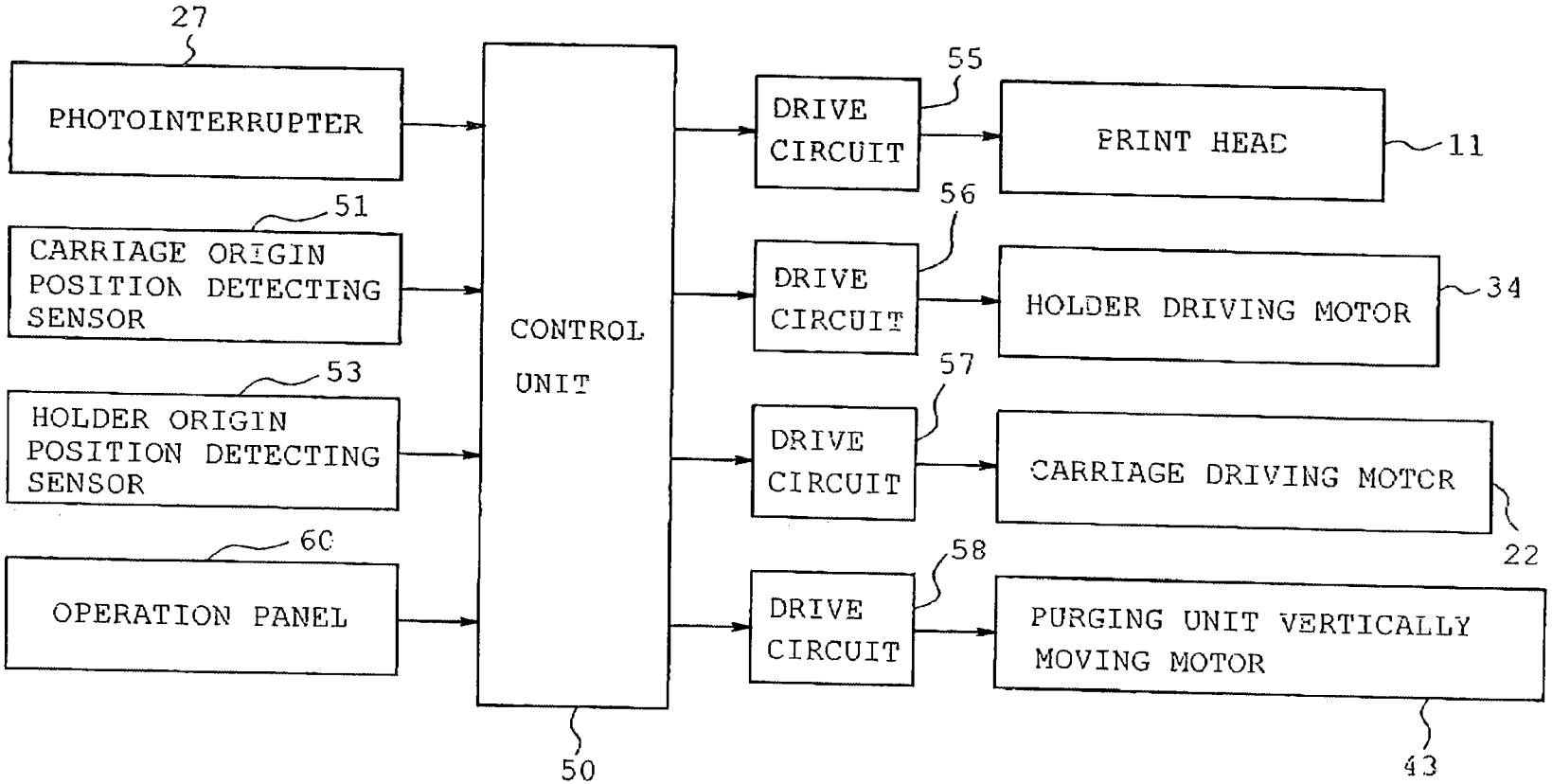
FIG. 9 is a block diagram of a control system of the cloth printing apparatus.

FIG. 9 schematically shows an arrangement of the control system of the cloth printing apparatus 1 of the embodiment. A control unit 50 controlling the whole cloth printing apparatus 1 comprises a microcomputer provided with a CPU, ROM, RAM, etc. To the control unit 50 are supplied an encoder signal from the photointerrupter 27, a carriage origin position signal form a carriage origin position detecting sensor 51, a holder origin position signal from a holder origin position detecting sensor 53 and various switch signals from an operation panel 60.

A carriage origin detection member 52 serving as a first origin detection member is provided on the carriage 10 as shown in FIG. 7. The carriage origin position detecting sensor 51 comprises a sensor (a photosensor, reed switch, microswitch or the like, for example) capable of detecting a carriage origin detection member 52. The carriage origin position detecting sensor 51 is adapted to detect the carriage origin detection member 52 when the carriage 10 is moved to a predetermined position, for example, a flushing position as shown in FIGS. 4 and 5. The control unit 50 sets an origin position of the carriage 10 based on the carriage origin position signal from the carriage origin position detecting sensor 51. Thus, the control unit 50 serves as a first origin position setting unit.

Figure 10:
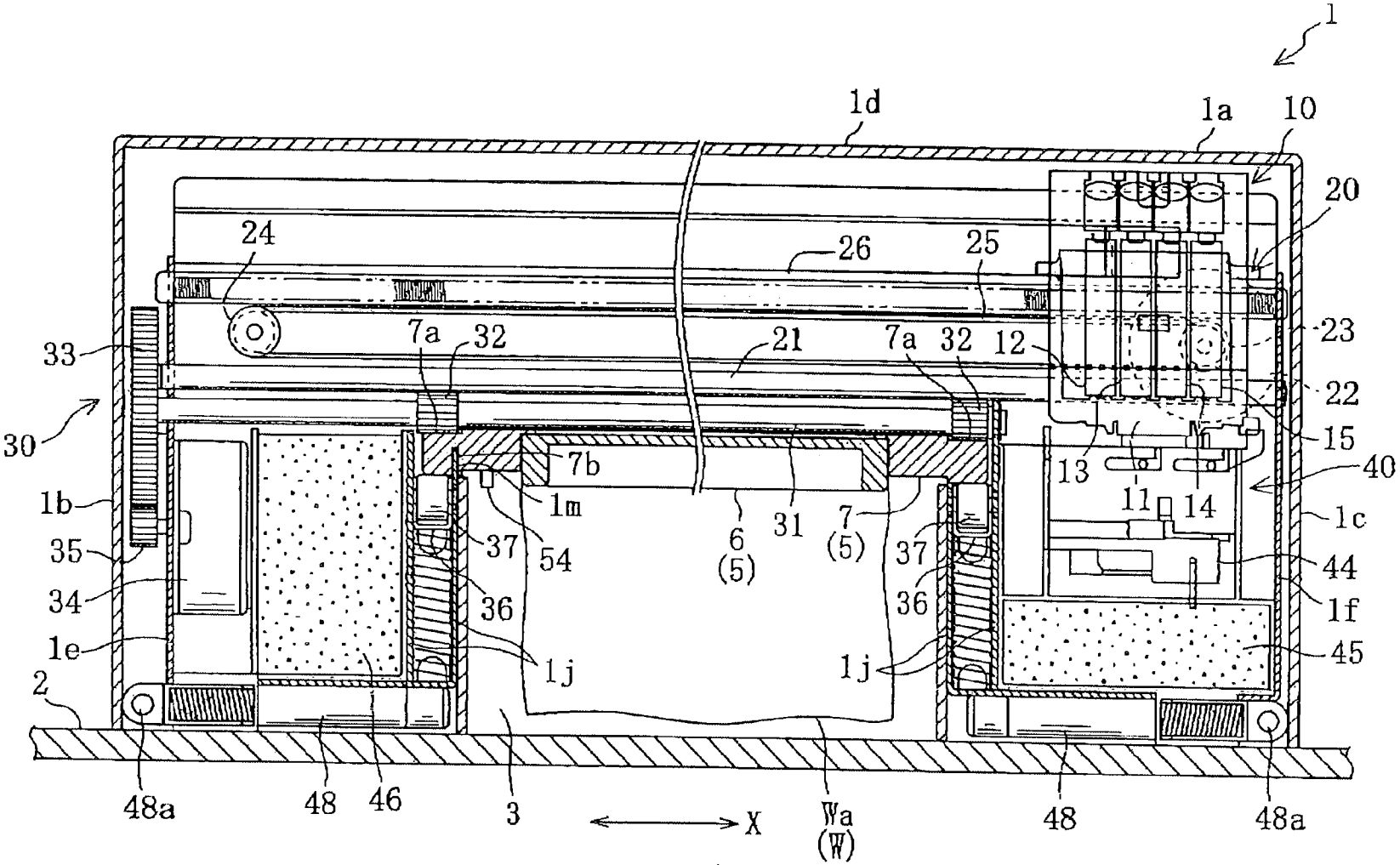
FIG. 10 is a view similar to FIG. 4, showing a print head assuming the purging position.
Figure 11:
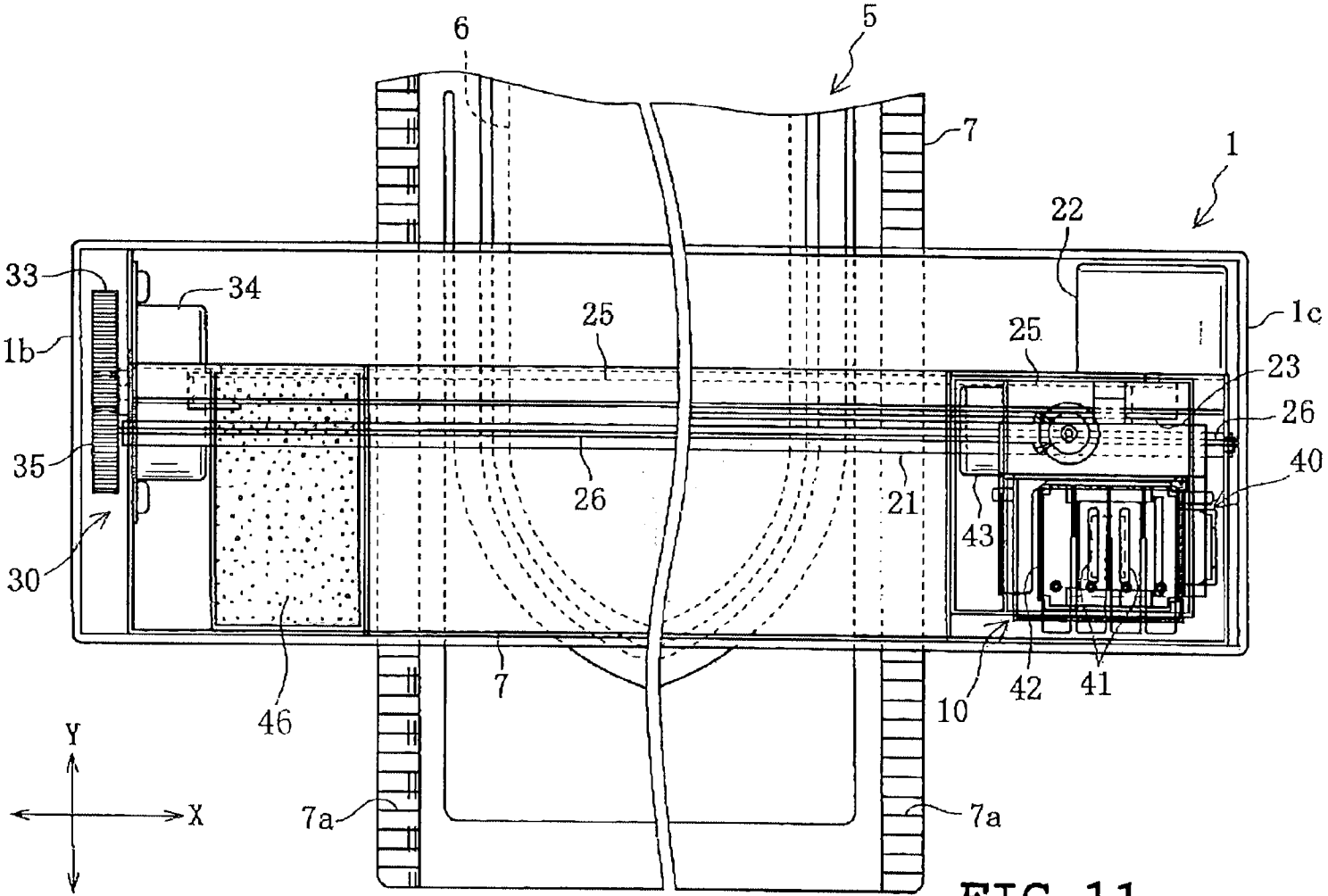
FIG. 11 is a view similar to FIG. 5, showing a print head assuming the purging position.

Furthermore, as shown in FIGS. 4 and 10, a holder origin position detection member 54 serving as a second origin detection member is provided on the left underside of the cloth holder 5 (outer holding member 7). The holder origin position detecting sensor 53 also comprises a sensor which is capable of detecting the holder origin position detection member 54 and is adapted to detect the member 54 when the cloth holder 5 is moved to a predetermined position, for example, an innermost position. The control unit 50 sets an origin position of the cloth holder 5 based on the holder origin position signal from the holder origin position detecting sensor 51. Thus, the control unit 50 serves as a second origin position setting unit.

The operation panel 60 includes a print start switch delivering a command of print start, a cloth holder attachment/detachment switch delivering a command of attachment/detachment of the cloth holder 5, a print stop switch terminating print, etc.

The control circuit 50 then controls the print head 11 via a drive circuit 55, the holder driving motor 34 via a drive circuit 56, a carriage driving motor 22 via a drive circuit 57 and a purging unit vertically moving motor 13 via a drive circuit 58. In this case, based on input print data and aforesaid input signals, the control circuit 50 controls the mechanisms in accordance with a previously stored control program, thereby carrying out a printing operation onto the workpiece cloth, the purging operation for the print head 11 and the like.

The operation and effect of the above-constructed cloth printing apparatus will now be described. When desiring to print on desired workpiece cloth, the worker attaches the workpiece cloth to the cloth holder 5 as shown in FIG. 3. In this case, the part Wa of the workpiece cloth outside the printing area hangs downward.

When the worker turns on the cloth holder attachment/detachment switch on the operation panel 60, the holder driving motor 34 is driven so that the cloth holder 5 which was used last time for printing is moved to a forefront attachment/detachment position. A printed cloth holder 5 is then detached and next, a cloth holder 5 holding a piece of new workpiece cloth to be sewn is set by inserting a front end thereof. The worker then operates the print start switch.

The holder driving motor 34 is driven so that the cloth holder 5 is moved to an innermost position, where an origin position is set. Thereafter, the cloth holder 5 is moved to the forefront or print start position. With this, after the purging operation has been carried out for the print head 11 assuming the purging position, the carriage driving motor 22 is driven so that the carriage 10 is reciprocated in the X direction, whereby the origin position is set. Subsequently, color printing is started on the basis of previously originated print data.

In the printing operation, while the carriage 10 is reciprocated in the X direction by the carriage driving motor 22, ink is injected from the print head 11 in synchronization with the movement of the carriage 10. When printing corresponding to one line (one way), tho cloth holder 5 is fed in the Y direction by one line print by the holder driving motor 34, and the feeding is repeated so that a predetermined pattern or figure in accordance with print data is printed on a print area of the workpiece cloth held on the cloth holder 5. In this case, since a plurality of rows of nozzles capable of injecting a plurality of colors of ink are arranged in the X direction, color printing can be performed by the use of a plurality of colors.

Furthermore, as described above, the print head 11 is suitably purged by the purging unit 40 or flushed during the printing operation, so that printing can be carried out while the print head 11 is usually kept clean. When printing is not carried out, the head surface of the print head 11 is covered with the head cap 41 and accordingly, ink can reliably be prevented from drying and the head surface can reliably be prevented from blurring by the invasion of dust or the like.

In the embodiment, the workpiece cloth can reliably be held in a stretched state of the printing area thereof by the use of the cloth holder 5. As described above, the cloth holder 5 is moved in the x direction without displacement by the engagement of the engagement portion 1*m* with the slide groove 7*b*, whereas the cloth holder 5 is moved accurately in the Y direction by the holder moving mechanism 30. Consequently, an accuracy of thee print position can be improved and accordingly, high-quality printing can be carried out for the workpiece cloth.

On the other hand, as described above, a part Wa of the workpiece cloth W held by the cloth holder 5 runs out of the cloth holder 5, hanging downward. Accordingly, if the hanging part Wa should come into contact with mechanisms for cloth feed (rollers) or the like, the contact would bring about obstacles to the cloth feed, or there is a possibility that the part Wa may be soiled or damaged. In the embodiment, however, the cloth passage 3 is ensured below the movement space of the cloth holder 5. Accordingly, the cloth part Wa hanging downward from the cloth holder 5 is allowed to be moved without causing any obstacle by the provision of the cloth passage 3. Consequently, the cloth feed can smoothly be carried out without soiling or damaging the cloth W and accordingly, printing can desirably be carried out.

Furthermore, when the workpiece cloth W to be held on the cloth holder 5 is relatively larger (for example, cloth wrapper, curtain or the like), the length of the hanging part Wa would become larger than the height of the cloth passage 3. As a result, it is supposed that the hanging part Wa would rub against the work table 2. In view of the aforesaid problem, when the workpiece cloth W is large as described above, a passage height adjusting legs 48 are caused to pivot to the operative positions thereby to stand, whereupon the height of the cloth passage 3 can be increased. Thus, since the height of the cloth passage 3 can be increased as occasion arises, printing can be carried out without soiling the workpiece cloth W even when the workpiece cloth W is relatively larger. Furthermore, since the passage height adjusting legs are usually kept in a folded state, the cloth printing apparatus 1 can be installed compactly.

The invention should not be limited by the foregoing first embodiment but may be modified as follows. In an embodiment as described below, the identical parts as those in the first embodiment are labeled by the same reference symbols and detailed description of these parts are eliminated. Only the difference of the second embodiment from the first embodiment will be described.

Figure 12:
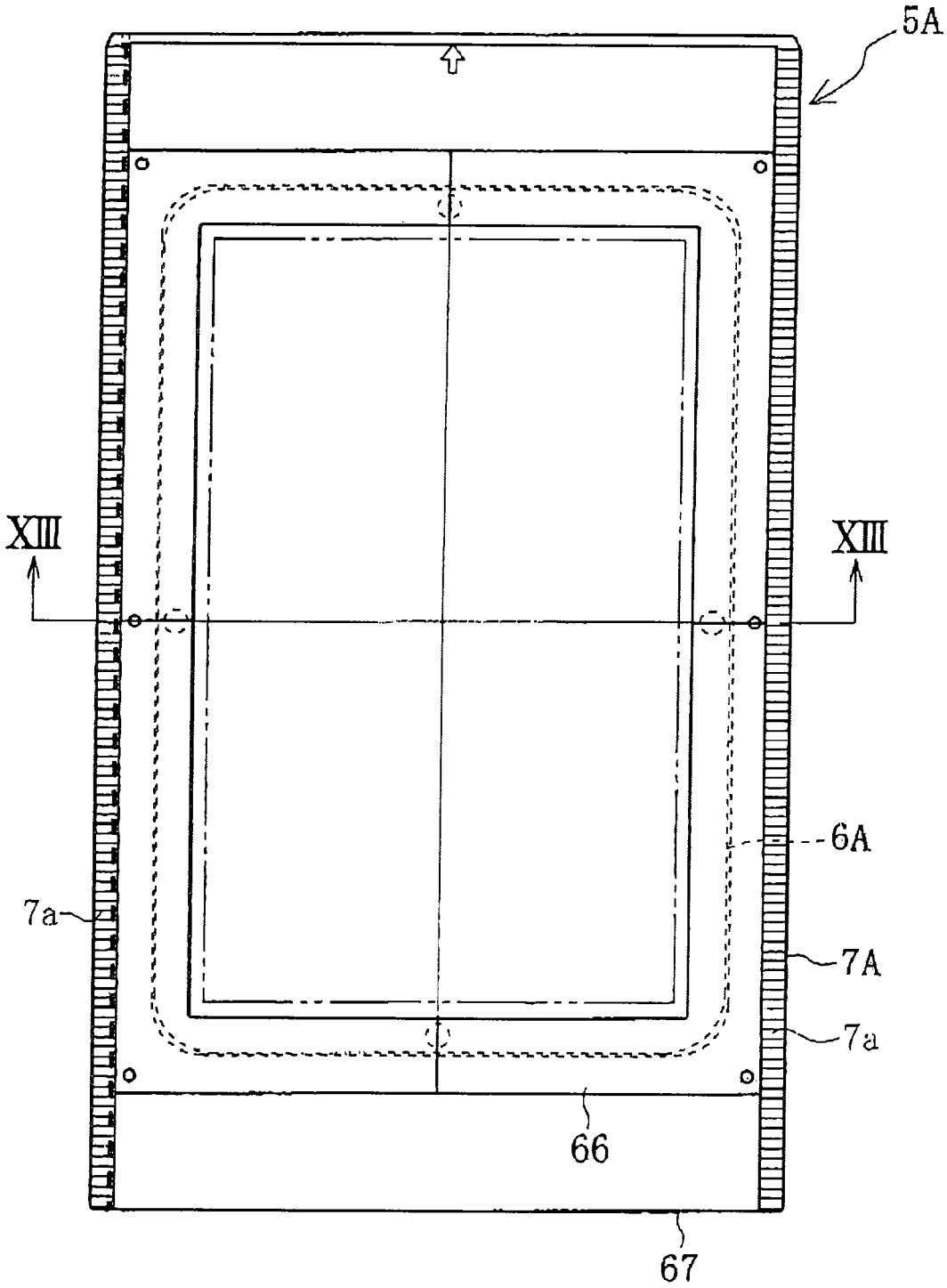
FIG. 12 is a plan view of the cloth holder in a second embodiment of the invention.
Figure 13:
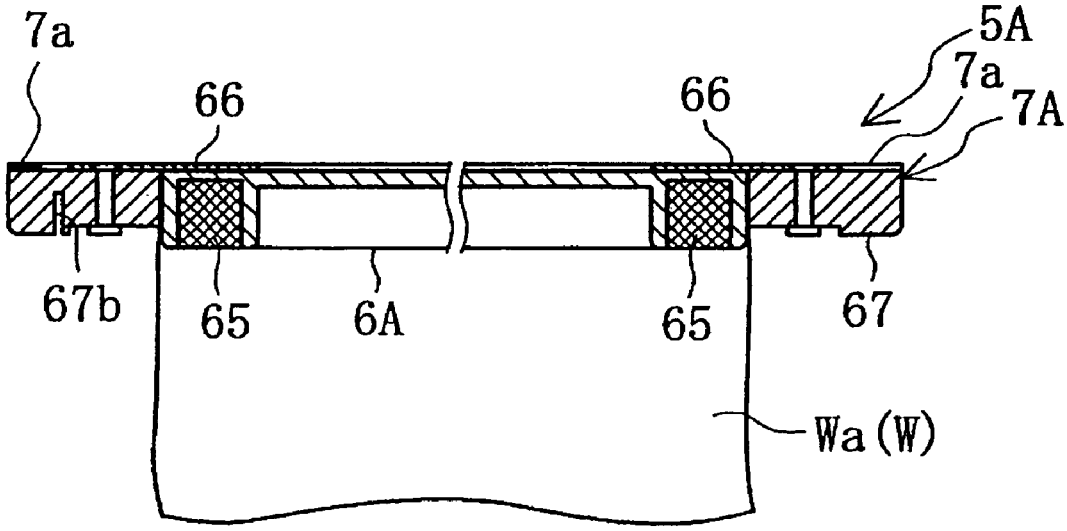
FIG. 13 is a longitudinally sectional front view of the cloth holder taken along line 13-13 in FIG. 12.

FIGS. 12 and 13 illustrate a second embodiment of the invention. The second embodiment differs from the first embodiment in the construction of the cloth holder 5A. The cloth holder 5A includes a first holding member 6A made of, for example, a synthetic resin and a frame-shaped second holding member 7A which is disposed so as to overlap an upper surface of the first holding member 6A in order to hold the workpiece cloth W. The first holding member 6A is formed into the shape of a rectangular plate with rounded corners and has magnets 65 secured to a plurality of portions (in this case, four central portions of the front, rear, right and left sides) on the underside thereof.

On the other hand, the second holding member 7A includes a rectangular support frame 67 and a rectangular frame member 66 formed integrally on an upper surface of the support frame 67. The support frame 67 is made of a non-magnetic material such as a synthetic resin, for example, and has an opening corresponding to (or slightly larger than) the shape of an outer periphery of the first holding member 6A. Furthermore, racks 7*a* extend the whole crosswise dimension of the support frame 67 along right and left sides of the upper surface of the support frame 67. The pinions 32 of the holder moving mechanism 30 are to come into mesh engagement with the racks 7*a*. Furthermore, a slide groove 7*b* is formed in the underside of the left end of the support frame 67 so as to extend the entire length of the support frame 6 in the movement direction of the cloth holder 5A (Y direction). The slide groove 7*b* engages the engagement portion 1*m*.

The rectangular frame member 66 is formed by shaping a thin plate made of a magnetic material such as iron into the shape of a rectangular frame. The rectangular frame member 66 has an opening which is smaller than that of the first holding member 6A. Accordingly, when the first and second holding members 6A and 7A are joined together, the inner periphery of the rectangular frame member 66 is adapted to overlap an outer periphery of the upper surface of the first holding member 6A.

In the above-described cloth holder 5A, a print area of the workpiece cloth W is placed on the upper surface of the first holding member 6A and subsequently, the support frame 67 of the second holding member 7A is fitted with the outer periphery of the first holding member 6A. In this case, the rectangular frame member 66 of the second holding member 7A is attracted by a magnetic attractive force of the magnets 65 provided on the first holding member 6A, whereupon the first and second holding members 6A and 7A are joined together with the workpiece cloth W being sandwiched therebetween, thereby holding the workpiece cloth W. As a result, the work for holding the workpiece cloth W on the cloth holder 5A can be simplified dramatically.

Figure 14:
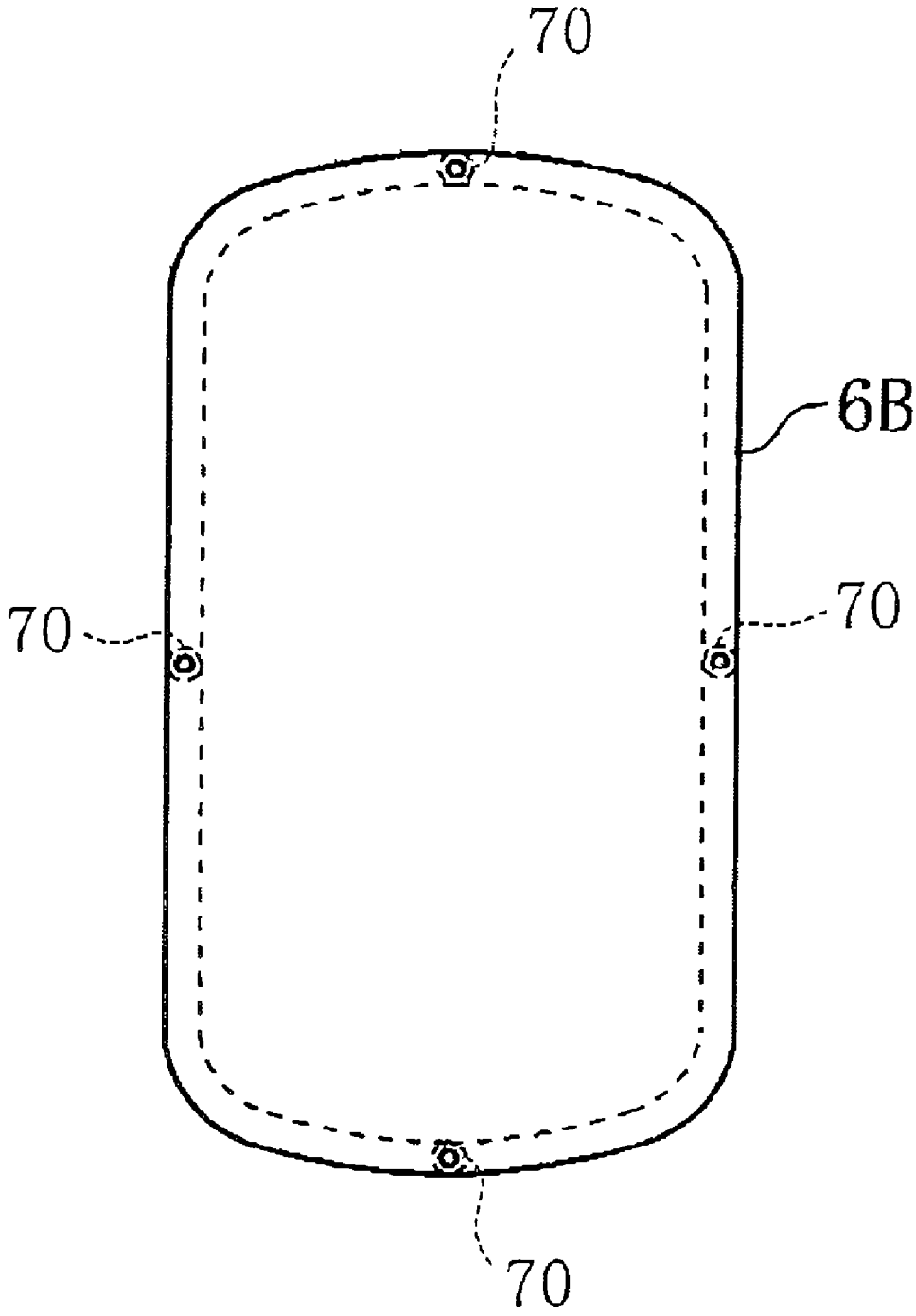
FIG. 14 is a plan view of the cloth holder in a third embodiment of the invention.
Figure 15:
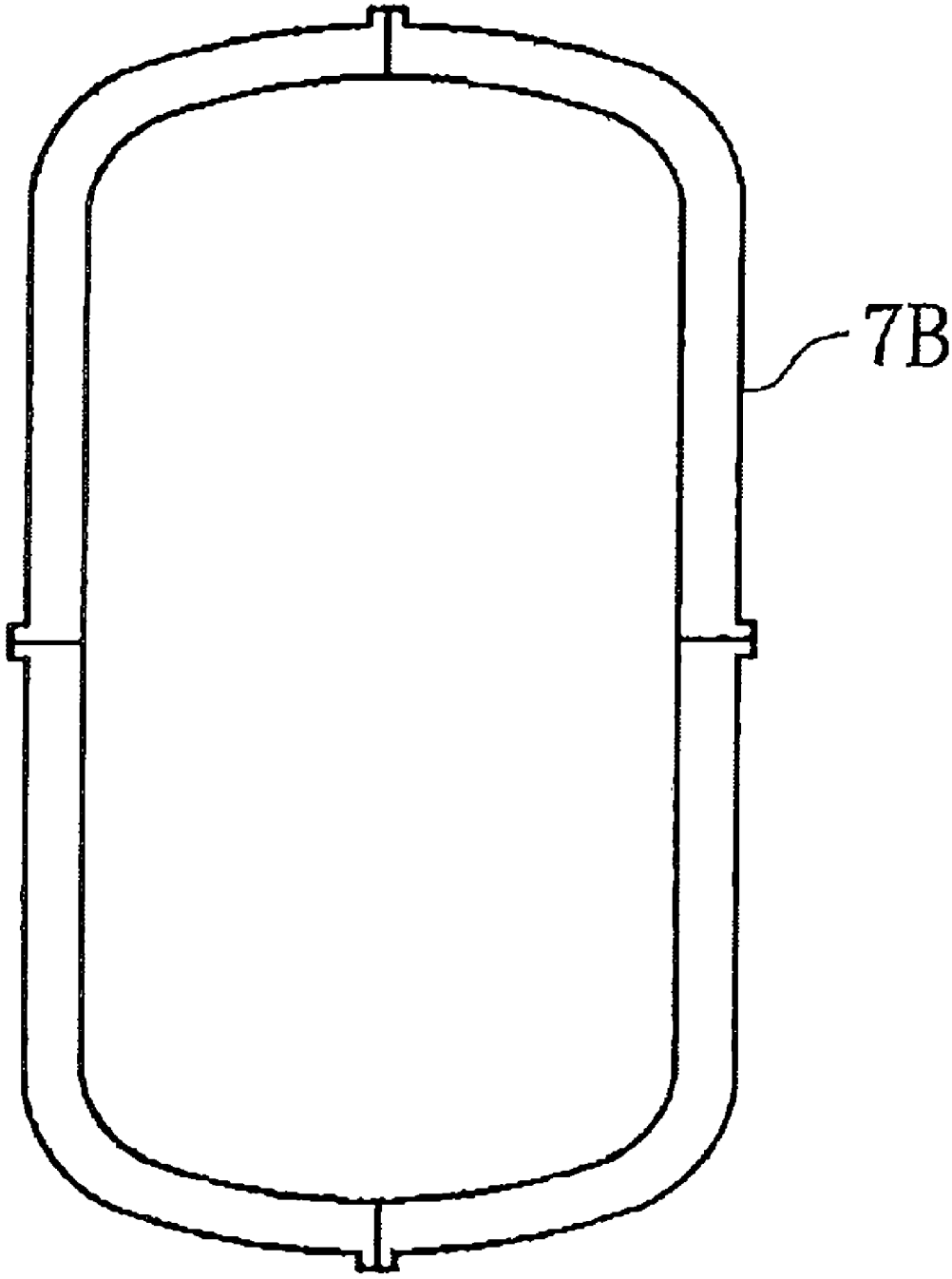
FIG. 15 is a plan view of the second holding member.
Figure 16:
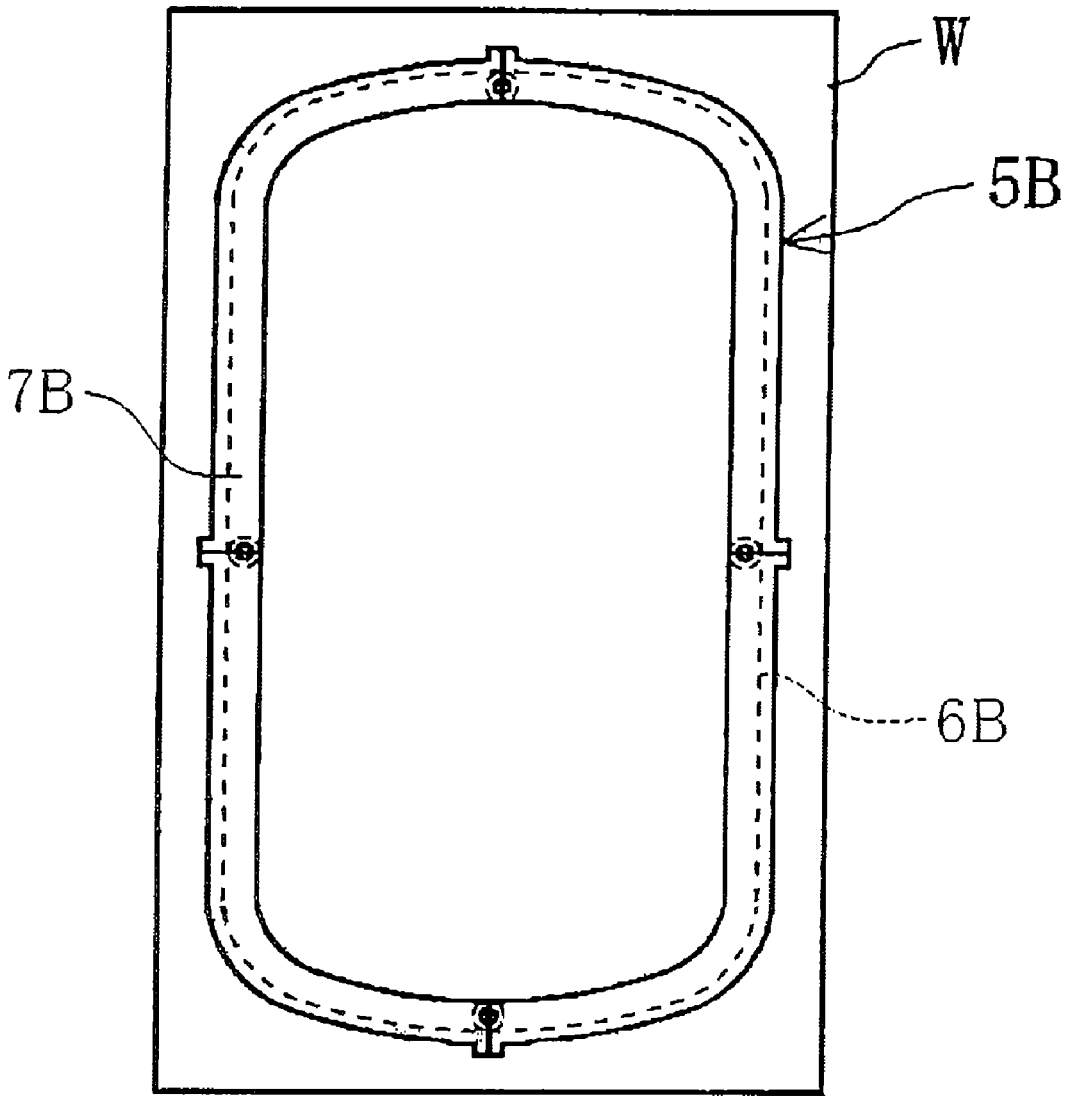
FIG. 16 is a plan view of the cloth holder.

FIGS. 14 to 20 illustrate a third embodiment of the invention. The third embodiment differs from the first and second embodiments in the construction of the cloth holder 5B. As shown in FIGS. 14 to 16, the cloth holder 5B includes a first holding member 6B and a frame-shaped second holding member 72 which is disposed so as to overlap an upper surface of the first holding member 63 thereby to hold the workpiece cloth W. Furthermore, the cloth holder 5B is supported on a discrete support frame 76 and moved by the holder moving mechanism 30.

Figure 18:
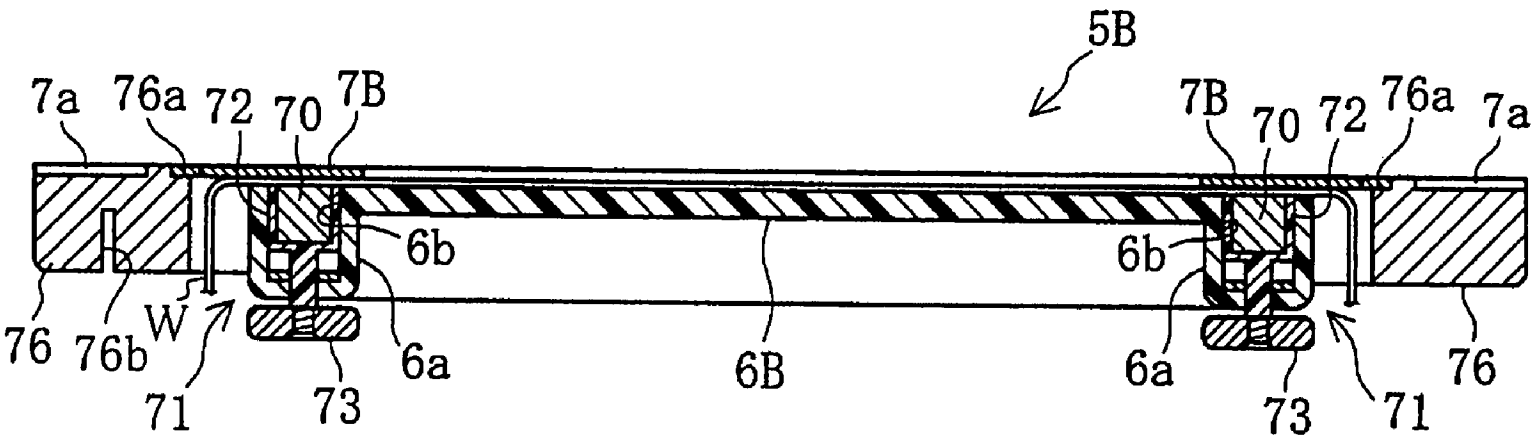
FIG. 18 is a longitudinally sectional front view of the support frame taken along line 18-18 in FIG. 17.

The first holding member 6B is formed into the shape of a rectangular plate made of a synthetic resin and having curved front and rear sides. A swollen portions 6*a* projecting downward is formed along the outer periphery of the underside of the first holding member 6B as shown in FIG. 18. The swollen portion 6*b* has cylindrical magnet accommodating holes 6*b* formed in suitable portions (for example, four portions) thereof. Columnar magnets 70 which are capable of attracting the second holding member 7B are accommodated in the magnet accommodating holes 6*b* respectively.

A magnet position switching mechanism 71 serving as a magnet position switching unit is provided in each magnet accommodating hole 6*b* for switching the magnet 70 between an attracting position where the magnet attracts the second holding member 7B and a non-attraction position spaced away from the second holding member 7B. The magnet position switching mechanism 71 will be described in detail later.

Figure 17:
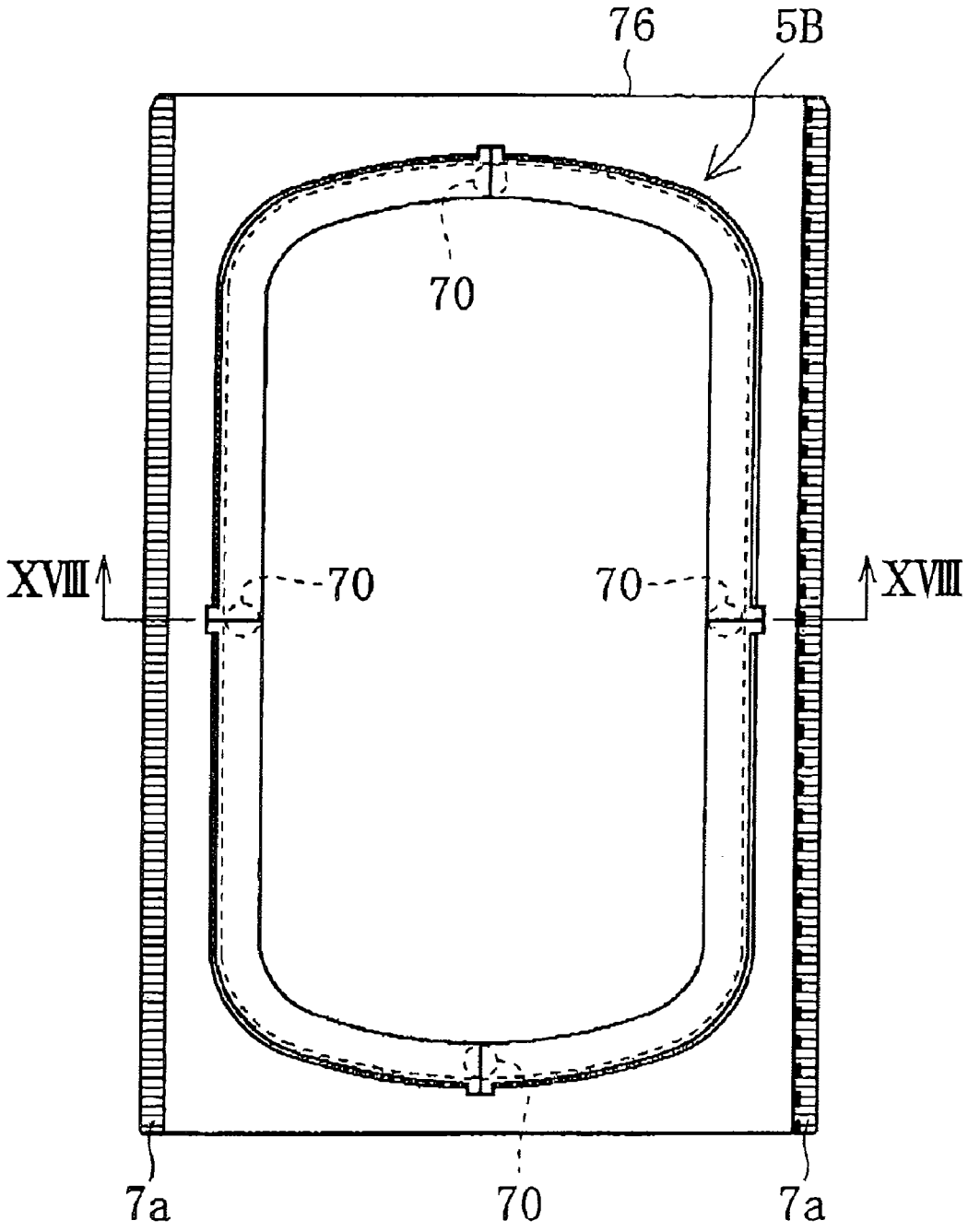
FIG. 17 is a plan view of a support frame.

The second holding member 7B is comprised of a magnetic plate such as iron and formed Into the shape of a frame corresponding to the outer periphery of the first holding member 6B. The support frame 76 is formed into the shape of a rectangular shape and has a step-like notch 76*a* formed for receiving an outer peripheral edge of the second holding member 7B as shown in FIGS. 17 and 18. The cloth holder 5B is fitted with the support frame 76 from above, and the outer peripheral edge of the second holding member 7B is placed on the notch 76*a*, whereby the support frame 76 supports the cloth holder 5B positioned in the frontward, rearward, leftward and rightward directions. Furthermore, the support frame 76 is formed with the racks 7*a* and the slide groove 67*b* as in the first and second embodiments.

Figure 19:
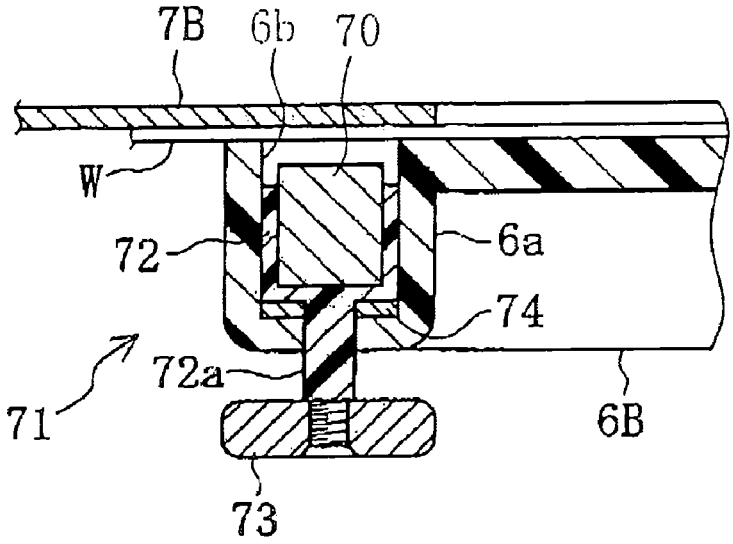
FIG. 19 is an enlarged longitudinally sectional front view of a magnet position switching mechanism in a non-attractive state.
Figure 20:
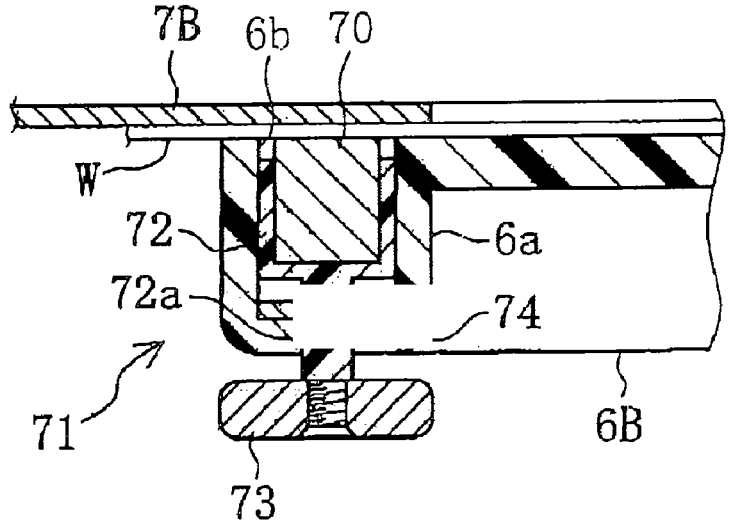
FIG. 20 is an enlarged longitudinally sectional front view of the magnet position switching mechanism in an attractive state.

The magnet position switching mechanism 71 is constructed as follows. As shown in FIGS. 18 to 20, tho magnet 70 is fitted into a cylindrical bottomed magnet holding member 72 having an upper opening thereby to be fixed in position. The magnet holding member 72 includes a shaft member 72*a* formed integrally therewith so as to extend downward from a central portion of the bottom wall thereof. A ring-shaped holding plate 74 made of a magnetic material is provided on the bottom of the cylindrical swollen portion 6*a* (the magnet accommodating hole 6*b*). Furthermore, the swollen portion 6*a* has a through hole formed through the bottom wall thereof.

The magnet holding member 72 on which the magnet 70 is mounted is accommodated in the magnet accommodating hole 6*b* so as to be vertically movable. In this case, the shaft member 72*a* projects downward through the hole of the bottom wall of the swollen portion 6*a*. The shaft member 72*a* has a lower end to which a knob 73 is screwed.

When the knob 73 is lowered downward so that the magnet 70 is switched to the non-attraction position together with the magnet holding member 72, the magnetic attractive force of the magnet 70 causes the magnet holding member 72 to react on the holding plate 74 such that the magnet 70 is hold at the non-attraction position by the magnetic attractive force, as shown in FIG. 19. Even when the magnetic force of the magnet 70 is relatively large, a suitable holding force can be obtained since the magnetic attractive force acts with the magnet holding member 72 being spaced away.

When the workpiece cloth W is to be held, the workpiece cloth W is placed on the first holding member 6B, and the second holding frame member 7B is placed on the outer periphery of the first holding member 6B so as to sandwich the workpiece cloth W from above in the state where a plurality of magnets 70 mounted on the first holding member 6B have been switched to the non-attraction position. In this case, the workpiece cloth W can be moved freely so that the print area thereof is located over the first holding member 6B. When the workpiece cloth W has been positioned, the knob 73 is pushed upward so that the magnets 70 are switched to the attraction position shown in FIG. 20 together with the magnet holding member 72. As a result, the magnets 70 are attracted by the second holding frame member 7B, whereupon the workpiece cloth W is reliably held by the first holding member 6B and the second holding frame member 7B.

According to the third embodiment, the work for holding the workpiece cloth W on the cloth holder 5B can be simplified markedly. Furthermore, the magnet position switching mechanism 71 is provided for switching the position of the magnets 70 between the non-attraction position and the attraction position. Consequently, the positioning work can readily be carried out when the workpiece cloth W is set on the cloth holder 5B (first holding member 6B), and the second holding frame 7B can be attracted by strong force and accordingly, the workpiece cloth W can reliably be held.

Figure 21:
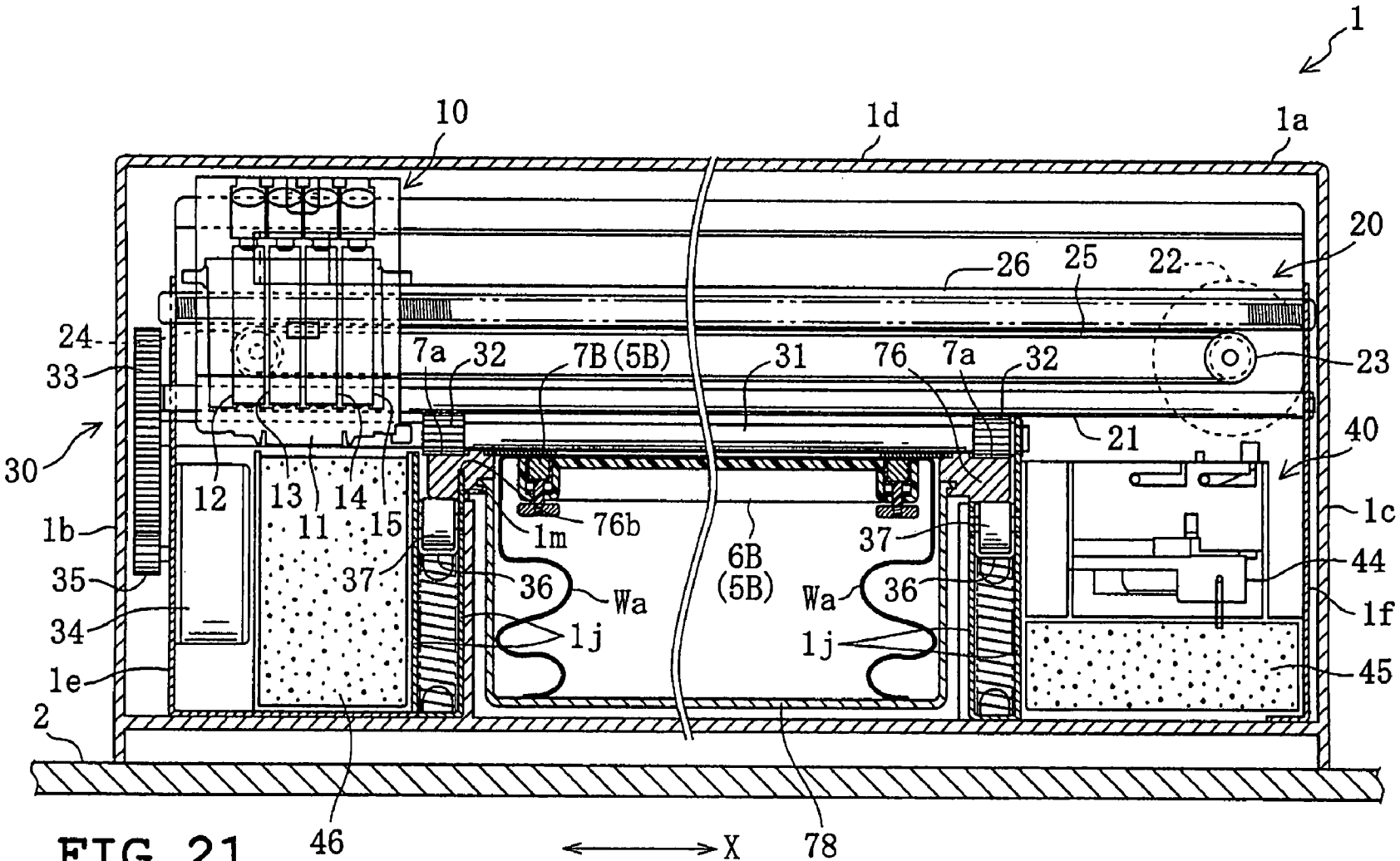
FIG. 21 is a view similar to FIG. 4, showing a fourth embodiment of the invention.

FIG. 21 illustrates a fourth embodiment of the invention. In this embodiment, a bucket-like cloth accommodating member 78 is provided on a lower part of the cloth holder 5B (support frame 76) employed in the third embodiment. The cloth accommodating member 78 has an upper end peripheral edge secured to an inner peripheral side edge of the support frame 76. Furthermore, no passage height adjusting legs 48 are provided. According to this construction, the cloth part Wa located outside the printing area and running out of the cloth holder 5B can be accommodated in the cloth accommodating member 78 in a folded state. Accordingly, even when the cloth part Wa located outside the printing area and running out of the cloth holder 5B is large, the workpiece cloth W can be prevented from interfering with the work table 2 or the like. In this case, the passage height adjusting legs 48 may riot be provided, whereupon the printing apparatus can be rendered compact.

The following modification is possible although not shown. The print head 11 may be of a single color type in which a single color of ink such as black, cyan, or the like is used for the printing.

A rubber sheet or various sheets each having a high friction resistance may be employed instead of the rack 7*a* formed on the cloth holders 5, 5A and 5B or the support frame 76.

The passage height adjusting legs 48 maybe constructed into a telescopic type so as to be stretched and contracted into a necessary length as the occasion requires.

The invention should not be limited by the embodiments as described above. Various modifications may be added without departing from the gist of the invention so that the invention can be applied to various types of cloth printing apparatus to which the cloth holder is attachable.

INDUSTRIAL APPLICABILITY

As described above, the cloth printing apparatus of the present invention is advantageous when print is carried out on cloth.

The invention claimed is:

1. An inkjet cloth printing apparatus provided with a print head capable of printing on a workpiece cloth, comprising:

a head moving mechanism moving the print head in a first direction;

a cloth holder holding a periphery of a printing area of the cloth on which the apparatus prints, wherein the cloth holder comprises a first holding member and a second holding member fitted with an outer portion of the first holding member;

a holder moving mechanism feeding the cloth holder in a second direction below the print head, the second direction being perpendicular to the first direction, wherein the holder moving mechanism comprises a rack which is formed on the second holding member so as to extend in the second direction, a pinion which is brought into mesh engagement with the rack, and a drive motor which rotates the pinion, wherein the second holding member has a slide groove formed therein for position restriction, and the slide groove extends in the second direction;

an engaging member provided on an apparatus body side for engaging the slide groove; and a cloth passage defined below a movement space through which the cloth holder is moved in the second direction by the holder moving mechanism so as to allow movement of part of the cloth located outside the printing area and running out of the cloth holder.

2. The cloth printing apparatus of claim 1, further comprising a passage height adjusting unit (48) for changing a height of the cloth passage.

3. The cloth printing apparatus of claim 1, wherein the cloth holder comprises a cloth accommodating member capable of accommodating said portion of the cloth in a folded state.

4. The cloth printing apparatus of claim 1, wherein the print head comprises a plurality of rows of nozzles which are capable of injecting ink of a plurality of colors, respectively, and are arranged in the first direction.

5. The cloth printing apparatus of claim 1, further comprising a purging mechanism purging the print head and a capping mechanism capping a head surface of the print head with a cap.

6. The cloth printing apparatus of claim 1, further comprising an origin detection member provided at the print head side and an origin position setting unit provided at the apparatus body side for detecting the origin detection member, thereby setting an origin position of the print head.

7. The cloth printing apparatus of claim 1, further comprising an origin detection member provided at the cloth holder side and an origin position setting unit provided at the apparatus body side for detecting said origin detection member, thereby setting an origin position of the cloth holder.

8. An inkjet cloth printing apparatus provided with a printed head capable of printing on workpiece cloth, comprising:

a head moving mechanism moving the print head in a first direction;

a cloth holder holding a periphery of a printing area of the cloth on which the apparatus prints, the cloth holder comprising a first holding member and a frame-shaped second holding member which is disposed so as to overlap an upper side of the first holding member, thereby holding the cloth, the cloth holder being supported by a support frame so as to be moved by the holder moving mechanism, the second holding member comprising a magnetic plate formed into a frame shape, the first holding member comprising a magnet magnetically attracting the second holding member;

a holder moving mechanism feeding the cloth holder in a second direction below the print head, the second direction being perpendicular to the first direction, the support frame having a slide groove formed therein for position restriction, wherein the slide groove extends in the second direction;

an engaging member provided on an apparatus body side for engaging the slide groove; and a cloth passage defined below a movement space through which the cloth holder is moved in the second direction by the holder moving mechanism so as to allow movement of part of the cloth located outside the printing area and running out of the cloth holder.

9. The cloth printing apparatus of claim 8, wherein the support frame is integral with the second holding member.

10. The cloth printing apparatus of claim 8, wherein the first holding member comprises a magnet position switching unit switching the magnet between an attraction position where the magnet attracts the second holding member and a non-attraction position where the magnet is spaced away from the second holding member.

11. The cloth printing apparatus of claim 8 wherein the holder moving mechanism comprises a rack which is formed on the supped frame so as to extend in the second direction, a pinion which is brought into mesh engagement with the rack, and a drive motor which rotates the pinion.

12. The cloth printing apparatus of claim 8, further comprising a passage height adjusting unit (48) for changing a height of the cloth passage.

13. The cloth printing apparatus of claim 8, wherein the cloth holder comprises a cloth accommodating member capable of accommodating said portion of the cloth in a folded state.

14. The cloth printing apparatus of claim 8, wherein the print head comprises a plurality of rows of nozzles which are capable of injecting ink of plurality of colors, respectively, and are arranged in the first direction.

15. The cloth printing apparatus of claim 8, further comprising a purging mechanism purging the print head and a capping mechanism capping a head surface of the print head with a cap.

16. The cloth printing apparatus of claim 8, further comprising an origin detection member provided at the print head side and an origin position setting unit provided at the apparatus body side for detecting the origin detection member, thereby setting an origin position of the print head.

17. The cloth printing apparatus of claim 8, further comprising an origin detection member provided at the cloth holder side and an origin position setting unit provided at the apparatus body side for detecting said origin detection member, thereby setting an origin position of the cloth holder.

* * * * *